US008201347B2

(12) United States Patent
Garza

(10) Patent No.: US 8,201,347 B2
(45) Date of Patent: Jun. 19, 2012

(54) SHOE CONSTRUCTION WITH ATTACHABLE COMPONENTS

(76) Inventor: Sandra Garza, West Chicago, IL (US)

( * ) Notice: Subject to any disclaimer, the term of this patent is extended or adjusted under 35 U.S.C. 154(b) by 668 days.

(21) Appl. No.: 12/319,665

(22) Filed: Jan. 8, 2009

(65) Prior Publication Data

US 2010/0170113 A1 Jul. 8, 2010

(51) Int. Cl.
*A43B 3/24* (2006.01)

(52) U.S. Cl. ..... 36/101; 36/11.5

(58) Field of Classification Search ..... 36/100, 36/101, 103, 45, 136, 132
See application file for complete search history.

(56) References Cited

U.S. PATENT DOCUMENTS

| | | | | | |
|---|---|---|---|---|---|
| 65,247 | A | | 5/1867 | Loveland | |
| 1,604,826 | A | | 10/1926 | Hornicek | |
| 1,608,072 | A | | 11/1926 | Thatcher | |
| 3,646,497 | A | | 2/1972 | Gillikin | |
| 3,797,136 | A | | 3/1974 | Soleri | |
| 3,878,626 | A | | 4/1975 | Isman | |
| 4,219,946 | A | | 9/1980 | Baum | |
| 4,363,177 | A | * | 12/1982 | Boros | 36/101 |
| 4,439,935 | A | * | 4/1984 | Kelly | 36/101 |
| 4,706,392 | A | | 11/1987 | Yang | |
| 4,887,369 | A | * | 12/1989 | Bailey et al. | 36/101 |
| 4,974,344 | A | | 12/1990 | Ching | |
| 5,339,543 | A | * | 8/1994 | Lin | 36/101 |
| 5,456,026 | A | | 10/1995 | Lewis | |
| 5,566,477 | A | | 10/1996 | Mathis et al. | |
| 5,581,910 | A | | 12/1996 | Lewis | |
| 5,644,857 | A | | 7/1997 | Ouellette et al. | |
| 5,675,916 | A | | 10/1997 | Lewis | |
| 5,992,058 | A | | 11/1999 | Jncid | |
| 6,023,858 | A | | 2/2000 | Srourian | |
| 6,598,324 | B1 | | 7/2003 | Tsuji | |
| 6,651,359 | B1 | | 11/2003 | Bricker | |
| 7,010,872 | B2 | | 3/2006 | Pawlus et al. | |
| 7,272,899 | B1 | * | 9/2007 | Marak | 36/101 |
| 7,584,555 | B2 | * | 9/2009 | Pearce | 36/101 |
| 7,698,834 | B1 | * | 4/2010 | Courville | 36/15 |
| D634,105 | S | * | 3/2011 | Cheshire et al. | D2/925 |

* cited by examiner

*Primary Examiner* — Jila Mohandesi
(74) *Attorney, Agent, or Firm* — Meroni & Meroni, P.C.; Charles F. Meroni, Jr.; Christopher J. Scott

(57) ABSTRACT

A shoe construction enables a user to attach or interchange shoe components for improving function and or appearance of the shoe construction. The shoe construction includes a base, a cover, a top attachable component, and two fasteners. The base includes a series of fastener-receiving apertures. First fastening structure surrounds the fastener-receiving apertures. The cover includes a second fastening structure matable with the first fastening structure. The top attachable component includes component ends, each of which has an end aperture and a third fastening structure, which third fastening structure surrounds the end apertures. The fasteners fasten the component ends to the base member via the end apertures and fastener-receiving apertures. The cover covers the first fastening structure, the component ends, and the fasteners. The first, second, and third fastening structures function to prevent rotation of the component ends about axes extending through the fasteners.

16 Claims, 14 Drawing Sheets

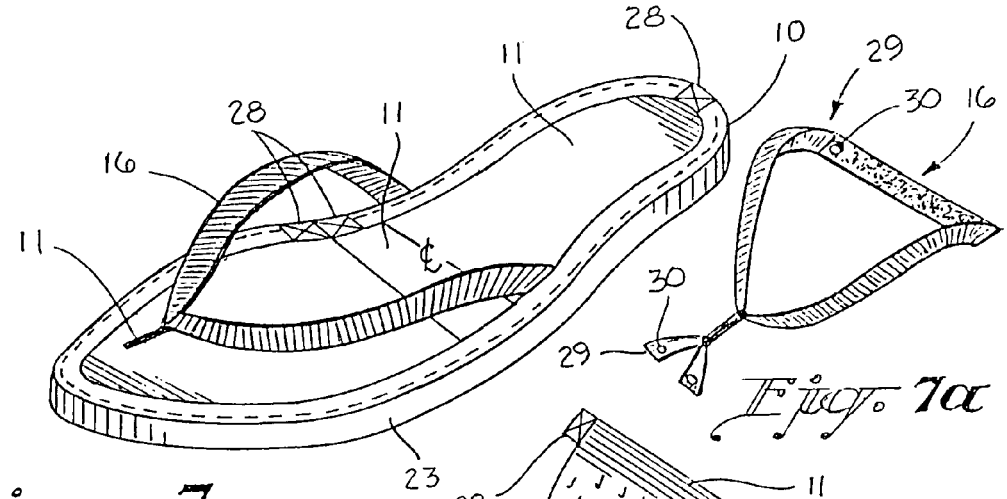
Fig. 7a
Fig. 7
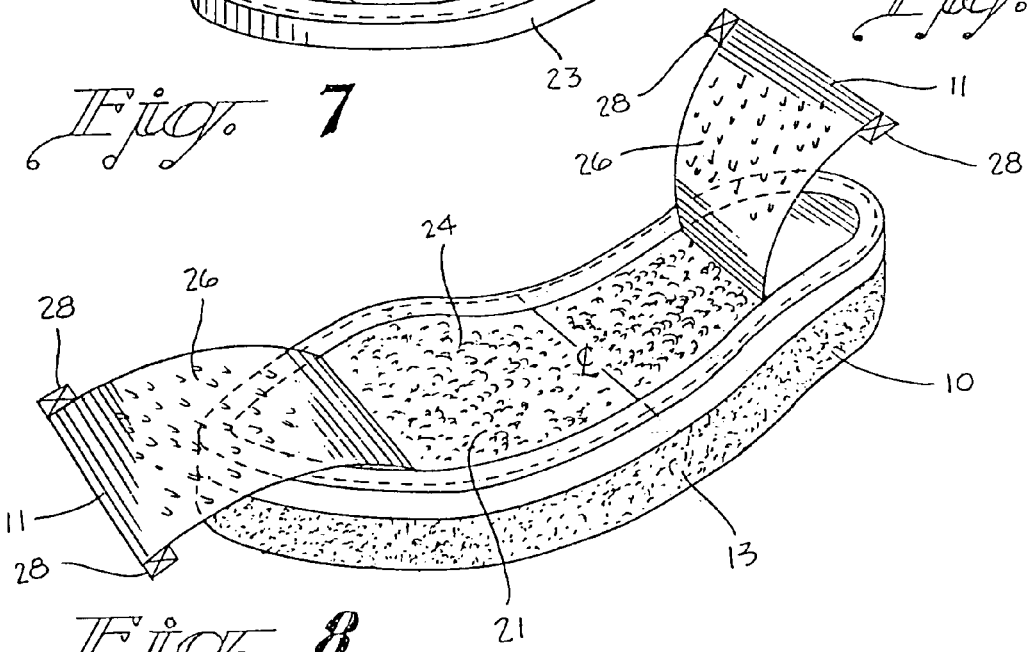
Fig. 8
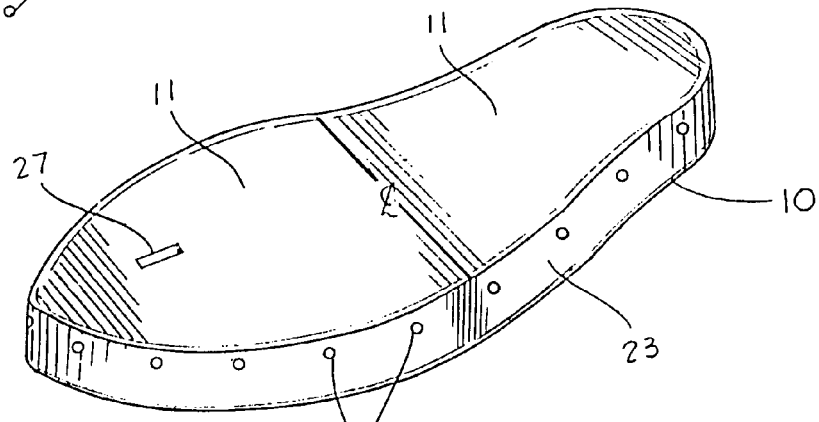
Fig. 9

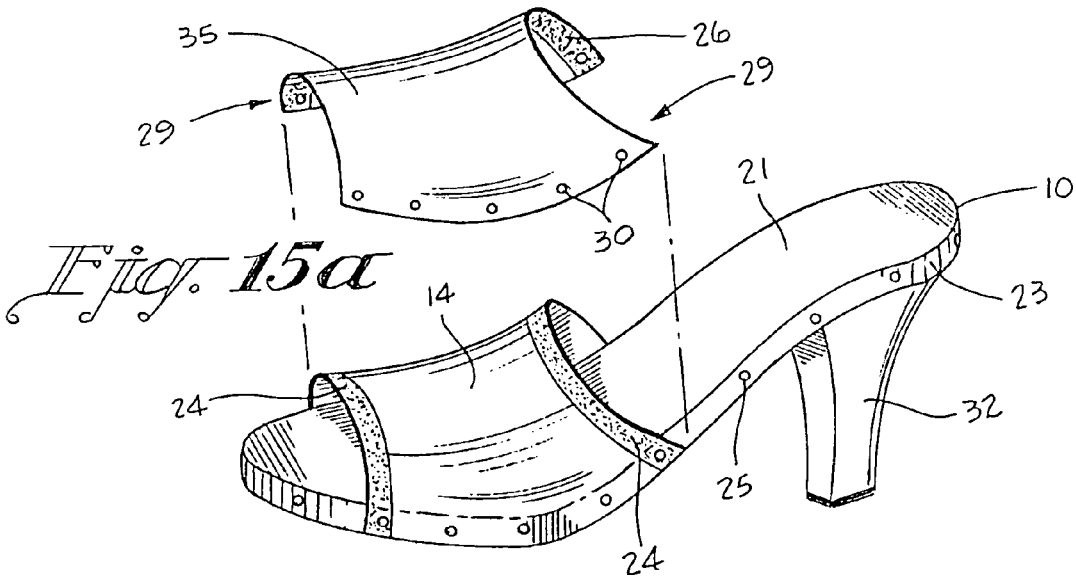
Fig. 15a
Fig. 15
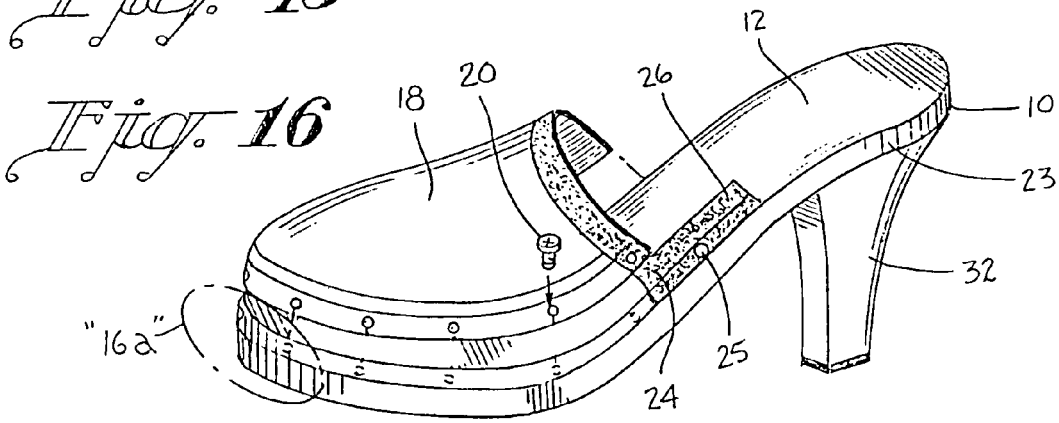
Fig. 16
Fig. 16a
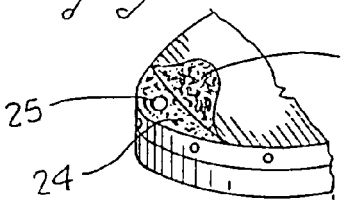
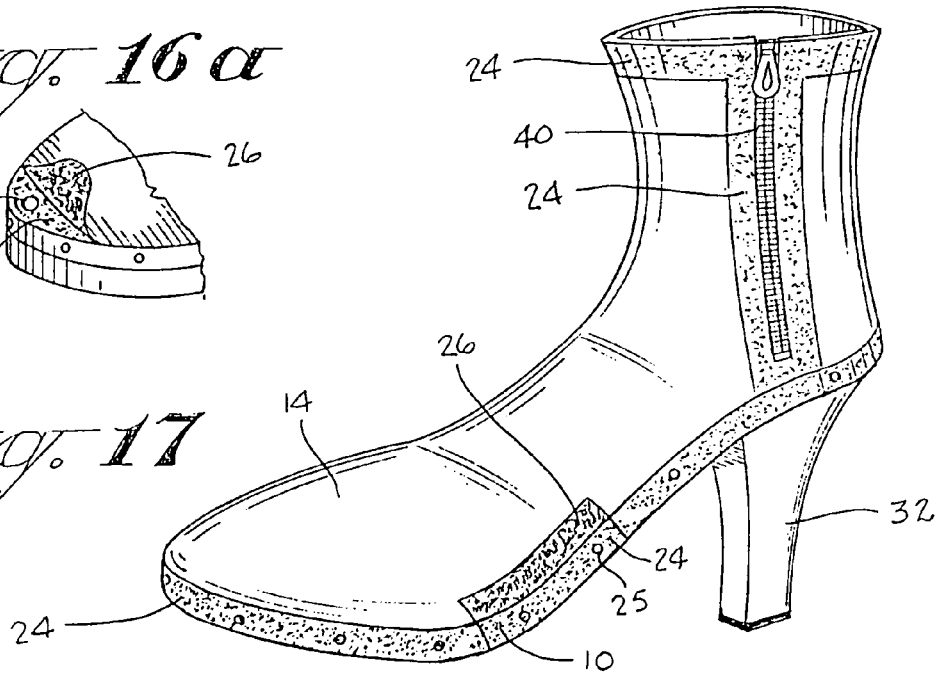
Fig. 17

SHOE CONSTRUCTION WITH ATTACHABLE COMPONENTS

BACKGROUND OF THE INVENTION

1. Field of the Invention

The present invention generally relates to a shoe construction. More particularly, the present invention relates to a shoe construction for enabling users or wearers of the shoe to attach and/or interchange functional and/or ornamental components to the shoe construction so as to improve function and/or appearance of the shoe.

2. Description of Related Art

A number of prior art patents disclose shoe constructions teaching interchangeable components such as uppers and heels. Some of the more pertinent prior art relating to shoe wear of these types are briefly described hereinafter.

U.S. Pat. No. 1,608,072 ('072 patent), which issued to Thatcher, discloses certain Means for Attaching Heels. The '072 patent describes an article of footwear having a heel seat, a locking member thereon of graduated height and having sides inclined horizontally in relation to the heel seat, and a heel having a recess having an open end an undercut side walls, adapted to receive said locking member in locking engagement therewith, whereby as the heel is moved along the heel seat it will be forced by said locking member against said seat.

U.S. Pat. No. 3,646,497 ('497 patent), which issued to Gillikin, discloses a Shoe with Interchangeable Heels. The '497 patent describes a shoe construction having angle irons mounted to the heel seat of the shoe for slidably mounting interchangeable low and high heels. An arch supporting plate is attached to the shoe shank for rendering vertical support to the shank when a high heel is utilized. An elastic band is attached to the upper opening for retaining the upper snugly against the wearer's foot. Stiffening strips are attached to oppositely-disposed vertical arch portions of the shoe to prevent outward bulging of this shoe portion when the high heel is employed.

U.S. Pat. No. 4,219,946 ('946 patent), which issued to Baum, discloses a Shoe with Interchangeable Heel. The '946 patent describes a shoe with an interchangeable heel comprising two parts, a main base member part reinforced in its rear end section by a rigid plate and a separate heel part. The heel part is fitted to the reinforced section of the base member part by a ferrule, fixed to one part, having a projecting portion of non-circular cross-section which locates in an aperture of complementary shape in the other part so as to position and prevent rotation of the heel, and a removable locking element is provided to lock the heel part in place.

U.S. Pat. No. 4,267,649 ('649 patent), which issued to Smith, discloses an Interchangeable Shoe. The '649 patent describes an article of footwear of an interchangeable nature permitting alteration by the wearer of the shoe appearance and configuration. There is provided an outbase member of unitary construction having toe, central, and heel portions, there being a heel unit carried upon the heel portion of wedge-defining character. A top base member sits upon the heel, having a forward portion attached to the central portion of the outbase member. The latter, heel unit and top base member are secured by a selectively removable cooperative fabric securement and/or T-arrangment. The inbase member overlies the toe of the outbase member, being detachably secured thereto, and preferably interengages portions of the top base member to provide a hinge-defining construction in the central portion of the shoe. A sock liner overlies the inbase member and top base member, being selectively and easily removed for access to the other elements of the shoe for interchangeability purposes. Various uppers providing front and rear quarters are detachably secured to the shoe at toe and heel portions thereof. A heel unit is covered with a detachable cover which is reversible for providing different exterior colors.

U.S. Pat. No. 5,581,910 ('910 patent), which issued to Lewis, discloses a Shoe with Interchangeable Heel. The '910 patent describes a shoe wherein its heel can be interchangeably attached to the heel portion of the outbase member of the shoe by extending a large bolt through an opening on the rear portion of the outbase member, such that it is threadedly engaged with a sleeve permanently mounted within a recess on top of the heel. A device is provided for anchoring and orientation of the heel.

U.S. Pat. No. 5,992,058 ('058 patent), which issued to Jneid, discloses a Detachable Shoe Strap System. The '058 patent describes a new detachable shoe strap system for providing an assortment of easily interchangeable styles of footwear in a single system. The inventive device includes a base member having upper and lower surfaces, and a perimeter side wall extending around the perimeter of the base member between the upper and lower surfaces of the base member. A heel is detachably coupled to the lower surface of the base member and is located towards the heel end of the base member member. The system includes a plurality of flexible straps. Each strap has a pair of opposing ends. Each end of each strap is detachably couplable to the perimeter side wall of the base member such that the inner surfaces of the straps face the base member.

U.S. Pat. No. 6,598,324 ('324 patent), which issued to Tsuji, discloses Bowling Shoes having Customizable Ground Engagement. The '324 patent describes a bowling shoe construction having various options for adjustment with removable and replaceable slide parts to attach to the tread surface of a slide shoe. The slide parts can attach interchangeably using hook and pile loop fasteners. A kick shoe includes an interchangeable kick part covering the toe area. The kick part can be attached using adhesives or hook and pile loop fasteners.

U.S. Pat. No. 6,651,359 ('359 patent), which issued to Bricker, discloses an Interchangeable Shoe Strap System. The '359 patent describes an interchangeable shoe strap system for altering the decorative look of a shoe. The interchangeable shoe strap system includes a shoe having strap members for securing the shoe to a user's foot, and a plurality of decorative strap covers which are selectively couplable to the strap members for altering the overall appearance of the shoe.

U.S. Pat. No. 7,171,768 ('768 patent), which issued to Klein, discloses a Modular Shoe System. The '768 patent describes a modular shoe system having interchangeable uppers and outbase members, comprising an internal support structure, a plurality of interchangeable first removable covers and a plurality of interchangeable second removable covers. The internal support structure includes a midbase member, a heel counter and a toe box. The internal support structure has a front portion including the toe box and a rear portion including the heel counter. Each of the first removable covers includes a front upper and a front outbase member. Each of the first removable covers is configured for being alternately removably attached to the front portion. Each of the second removable covers includes a rear upper and a rear outbase member. Each of the second removable covers is configured for being alternately removably attached to the rear portion.

U.S. Pat. No. 7,210,251 ('251 patent), which issued to Rolle, discloses a Shoe with Interchangeable Covers. The '251 patent describes a modified pair of women's shoes consisting of a base, a base member with a removable heel, and a cover which is attached to the base and the base member with two sets of straps joining under the base member and fastened together with hook and loop type fasteners. The base of the shoe features a layer of padding for extra comfort and low rising vertical sides for supporting the interchangeable cover. The base member of the shoe is formed with a pair of notches on the bottom, one in the toe area and one in the arch area. These notches serve as guides into which the straps are placed and secured to one another. The cover can be made in various styles from dressy and elegant to casual and sporty by adding decorative items, such as zippers, buttons, bows, and the like and by varying the heel height and width. The interchangeable covers and heels allow the owner to have numerous pairs of shoes for the price of one. Thus any woman could save money through the purchase of one pair of shoes as opposed to purchasing shoes to coordinate with every outfit in her wardrobe. Additionally, the female traveler could pack a single pair of shoes to complete a number of ensembles, thereby reducing the load with which she travels.

U.S. Pat. No. 7,219,445 ('445 patent), which issued to Stern, discloses a Locking Mechanism for Securing Detachable Shoe Uppers. The '445 patent describes an attachment mechanism and system used to accessorize, customize and/or personalize footwear with interchangeable uppers or straps, especially open shoes and sandals. More particularly, this invention presents a safe, secure and easy system for the attachment and detachment of shoe uppers and straps to shoes and sandals. This invention allows both the manufacturer and wearer to promote and display fashion and theme material of their own choosing, with the freedom to change the material or message without having to change footwear. The invention comprises a releasable fastener that connects a retainer, secured with the base member of the footwear, to an upper or strap. The releasable fastener is comprised of an upper and lower bar or metal loop, each loop carried on a barrel, the barrels interlocking with each other in a sliding engagement and held in the closed or engaged position by a magnet or by a biasing member.

Unite States Patent Application Publication No. US 2003/0192205, which was authored by Linens, describes a shoe cover system for Clog and Loafer type shoes that allow you to change the appearance of the shoes as desired. The shoe covers allow the wearer to partially change the top and side appearance of a pair of shoes to different colors, shapes, prints, designs, textures or styles. The covers provide a fast and inexpensive way to match the shoes to a varied wardrobe in just a few seconds.

United States Patent Application Publication No. US 2003/0233772, which was authored by Musial, describes a shoe having a plurality of interchangeable top covering for altering the appearance of a shoe. The shoe includes a shoe base and at least one top covering for the shoe. The top covering is removably affixed to the shoe base. In the preferred embodiment of the present invention, the top covering is positioned over a top portion of the wearer's foot, in front of the wearer's ankle. The top covering may be attached by any fastening means, such as hook and pile strips, snaps, laces, or hooks. When the wearer desires, the top covering is exchanged for another top covering to alter the exterior appearance of the shoe.

United States Patent Application Publication No. US 2004/0064976, which was authored by Barteet, describes an interchangeable shoe ensemble including a base member, or base member, having snaps secured along its periphery and positioned for snap fitting engagement with corresponding snaps on a removable strap. The strap is provided having a silk-screened design provided on its upper surface for aesthetic purposes. The configuration of the shoe lends itself to quick and efficient replacement of the strap where, for example, an alternative strap design is desired.

United States Patent Application Publication No. US 2005/0016026, which was authored by Long, describes athletic shoes which have evolved into a very desirable and trendy piece of clothing. They are available in many shapes, sizes, and colors. However, to date all shoe pieces and designs are fixed to the shoe. My technology will allow shoe colors and or designs to be changed daily and as easily as the rest of one's clothes while utilizing only one pair of shoes. Interchangeable pieces will be made useful just as different colored shoe strings are now available.

United States Patent Application Publication No. US 2005/0066550, which was authored by Liu, describes a women's shoe which includes a base member, a heel and a base strap secured to opposite sides of the shoe and positioned to extend across of the wearer's foot. Strap covers are provided in various colors, materials, shapes and decorative surface patterns. The strap covers are each removably attachable to the base straps, in covering relation thereto, and are selectively interchangeable to provide a variety of different styles and appearances, thereby allowing the same shoe to be worn with many different outfits. The shoes are provided in different sizes, heel shapes and heights to further enhance the versatility of style and appearance, ranging from formal to casual.

United States Patent Application Publication No. US 2008/0098622, which was authored by Berrins, describes a sandal comprising layered footwear components includes a lower base, a middle member replaceable platform which secures the straps, and an upper member replaceable inbase member. A hollowed out center area creates a perimeter side wall on the top of the base into which the platform is stored. A frontal (toe area) and rear (heel area) ledge crosses the toe and heel areas of the superior base horizontally. The straps are attached to a platform and secured by a present choice of a hook and loop fastener. The front and rear of the platform is eased under the front and rear ledges on the base. A midpoint lock on the platform further secures the platform to the base. A final top layer inbase member is secured on top of the platform and under the overlapped straps and placed into the remaining hollow area of the base hiding the shoes components. The straps and inbase member cooperate to form a shoe upper for receiving the foot. Platforms and inbase members are interchangeable to heel, flat or wedge style bases. Exchangeably connected straps to platforms are repeatedly adjustable in horizontal and vertical directions for comfort and mix and match to create many shoe styles.

It may be seen from an inspection of the prior art that the art is silent on a shoe construction having a base member with (1) a series of peripherally spaced fastener-receiving apertures wherein the fastener-receiving apertures extend orthogonally and/or parallel to the top surface adjacent the peripheral surface each of which are surrounded with hook or loop type fastening structure, (2) a cover construction having matable loop or hook type fastening structure, matable with the base member fastening structure, and hardware type fasteners for attaching components to the base member such that the hook and loop fastening structure, in cooperation with the hardware type fasteners function to prevent displacement of the attached components relative to the base member. The prior art thus perceives a need for such a shoe construction, the particulars of which are set forth in more detail hereinafter.

SUMMARY OF THE INVENTION

In view of the fact that the prior art is silent on a shoe construction having dual means for restricting movement of attached components at the junction site of the a top or bottom attachable component and a base member. To achieve this and other readily apparent objectives, the present invention essentially discloses a shoe construction for enabling a user or wearer to selectively attach shoe components for improving function and or appearance of the shoe construction. The shoe construction according to the present invention comprises a base member, a cover construction, at least one top attachable component, and at least two fasteners.

The base member comprises a top surface, a bottom surface, a peripheral surface, a first fastening structure, and a series of fastener-receiving apertures. The top and bottom surfaces are substantially parallel to one another while the peripheral surface extends orthogonally intermediate the top and bottom surfaces. The first fastening structure surrounds the fastener-receiving apertures.

The cover construction comprises a second fastening structure matable with the first fastening structure. The top attachable component comprises first and second component ends, each of which comprise an end aperture and a third fastening structure, which third fastening structure surrounds the end apertures. The fasteners fasten the first and second component ends to the base member via the end apertures and fastener-receiving apertures. The cover functions to selectively and removably cover (1) the first fastening structure, (2) the first and second component ends, and (3) the fasteners. The first, second, and third fastening structures function to prevent rotation of the first and second component ends about axes extending through (and coaxial with) the fasteners.

BRIEF DESCRIPTION OF THE DRAWINGS

Other features of my invention will become more evident from a consideration of the following brief description of patent drawings:

FIG. 7 is a top perspective view of a shoe construction showing the flaps repositioned and attached over the underlying base member construction thereby concealing the loop construction and apertures and showing an exposed thong-like strap construction extending from the fore-foot region to the rear-foot region.

FIG. 7(*a*) is a top perspective view of the thong-like strap construction otherwise depicted in FIG. 7 as exploded from the shoe construction.

FIG. 8 is a top perspective view of an alternative embodiment of the shoe construction according to the present invention showing fore-foot and rear-foot flap sections turned upward and toward the shoe front and shoe rear respectively thereby exposing a relatively thick underlying shoe construction as compared to the shoe construction shown in FIG. 1.

FIG. 9 is a top perspective view of the shoe construction otherwise shown in FIG. 8 showing (1) fore-foot and rear-foot flap sections repositioned and attached over the surface of the underlying base member construction thereby concealing the loop construction and showing an opening formed in the flap at the fore-foot region, and (2) the peripheral cover removed to show underlying apertures formed in the periphery of the shoe construction parallel to the plane of the surface of the underlying shoe construction.

FIG. 11(*a*) is a top perspective view of the thong-like strap construction otherwise shown in FIG. 11 as exploded from the shoe construction.

FIG. 13(*a*) is a fragmentary top perspective view of an alternative shoe construction showing a fragmentary base member and a heel member having apertures orthogonal to the axis of the heel member.

FIG. 13(*b*) is a fragmentary bottom view of the base member otherwise depicted in FIG. 13 showing medially aligned apertures.

FIG. 15 is a top perspective view of an alternative shoe construction showing a base member, a heel member attached to the base member, and a strap member attached to the base member, the base member comprising peripheral apertures parallel to the plane of the base member, and the strap member comprising loop fastening structure.

FIG. 15(*a*) is a top perspective view of a strap member cover exploded from the strap member otherwise depicted in FIG. 15, which strap member cover comprises (1) hook fastening structure for attachment to the strap member and (2) apertures for cooperable attachment to the base member via fasteners (not specifically illustrated).

FIG. 16(*a*) is a fragmentary top perspective view of a front portion of the shoe construction otherwise depicted in FIG. 16 showing an aperture as exposed by an upturned section of the base member cover.

FIG. 16(*b*) is a fragmentary top perspective view of a front portion of the shoe construction otherwise depicted in FIG. 16 showing the base member cover exploded from the base member.

FIG. 17(*a*) is a top perspective view of an alternative shoe construction according to the present invention showing an upper-type cover member, a heel member, and an upper member attached to the cover member, the upper member (1) being upturned at one section thereof to show underlying peripheral apertures, and (2) comprising interior hook fastening structure.

FIG. 17(*b*) is a top perspective view of an alternative shoe construction according to the present invention showing an upper member (concealing the base member and upper-type cover member) and a heel member, the upper member being attached to the base member and upper-type cover member via (1) hook and loop fastening structure and (2) peripheral fasteners parallel to the plane of the base member.

FIG. 18(*a*) depicts plan views of the strap members otherwise depicted in FIG. 18.

DETAILED DESCRIPTION OF THE PREFERRED EMBODIMENT(S)

Figure 1:
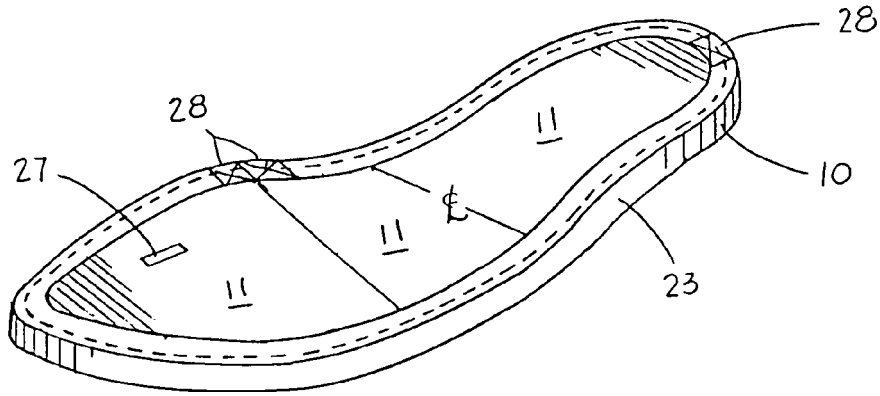
FIG. 1 is a top perspective view of a preferred, substantially planar base member construction according to the present invention showing three regions, namely a fore-foot region, a mid-foot region, and a rear-foot region, each region covered with a flap, each flap having a flap tab, an opening being formed in the flap at the fore-foot region.

Shoes may be worn for any number of reasons. Most typically, shoes may be worn for fashion and for providing certain foot-covering means, or for maintaining the wearer's feet at a preferred temperature state (i.e. the shoes may be worn to keep the feet warm or cool), or for protecting the user's feet from the elements. The present invention provides a shoe construction designed for enabling a user to attach select components to a base shoe assembly so as to creatively build a reliably sound shoe with adornments as may be elected by the user or wearer.

Accordingly, and referring to the drawings now with more specificity, the present invention provides a shoe construction for enabling a user to selectively attach shoe components. The shoe construction essentially comprises a base member 10 such as a flat; a cover construction as may be exemplified by flaps 11, a top cover strip as at 12, a side cover strip as at 13, or an upper type cover as at 14; at least one top attachable component as may be exemplified by straight strap members 15, tie-type thong-like strap members 16, Y-type thong-like strap members 17, band-type strap members 18, or T-type strap members 19; and at least two fasteners as may be exemplified by a threaded, screw type fasteners 20.

The base member comprises a top surface as at 21, a bottom surface as at 22, a peripheral surface as at 23, a first fastening structure such as VELCRO brand loop type fastening structure 24; and a series of peripherally spaced fastener-receiving apertures 25 as may be exemplified by threaded apertures for receiving threaded screw type fasteners 20. It is contemplated that the base member 10 may be preferably constructed from materials such as rubber, leather, foam, hemp, wood, cork, or any suitable material that lends itself to the design.

It may be seen from an inspection of the relative figures that the top and bottom surfaces 21 and 22 are preferably substantially parallel to one another, and that the peripheral surface 23 extends substantially orthogonally intermediate the top and bottom surfaces 21 and 22. The fastener-receiving apertures 25 may extend orthogonally and/or parallel to the top surface adjacent the peripheral surface 23. It may be further seen from an inspection of FIG. 44 that the first fastening structure as exemplified by loop type fastening structure 24, preferably surrounds the fastener-receiving aperture(s) 25.

The apertures 25 are not limited in number or arrangement around the periphery of the shoe construction or base member 10, and may be selectively formed so as to provide the shoe construction with the ability to attach components thereto as elected by the user. Further, it is contemplated that the apertures 25 may be formed in magnetic material on the order of 2-3 mm in diameter and that the fasteners 20 may be similarly constructed from magnetic material and sized and shaped so that the engagement thereof with the apertures 25 may be made for robust. The screws or fasteners may be on the order of 3-6 mm in length depending on the base member thickness.

As earlier indicated, the cover construction may be exemplified by flaps 11, top-type cover strips 12, side-type cover strips 13, or upper-type covers 14, all of which may comprise tabs as at 28. Flaps 11 or top-type cover strips 12 preferably comprise an opening (or component aperture) as at 27 for receiving structure or letting or allowing structure such as straps 15 to pass therethrough. The cover construction may further comprise gel type inserts or bubble-type inserts (not specifically illustrated) so as to enhance the comfort of the shoe construction to the wearer.

A fastener receiving aperture 25 or other attachment structure (such as the first fastening structure 24) may be formed beneath opening 27 so as to enable attachment of the structure to underlying base member 10. It is contemplated that the cover construction may preferably have a thickness on the order of 2-3 mm, and that the base member 10 may comprise a depression of a similar depth to accommodate the cover construction so that the shoe construction, with cover construction in an assembled, down position is flush or planar across the top surface.

It is contemplated that the flaps 11 at the fore-foot and rear-foot region, particular with regard to the shoe constructions illustrated in FIGS. 3-5 and 8-12, are preferably attached to the base member 10 at extreme ends thereof so that replacement of the flaps 11 upon the underlying base member construction is more easily achieved. The pressure of the user's foot helps keep the cover construction secure and flaps 11 in position. Further, the adherence of the flap 11 at the rear-foot region helps keep the flap 11 from becoming disengaged from the base member 10 since the movement of one's heel during a routine gait at the site of the rear-foot flap 11 is more active.

The cover construction, in any event, preferably comprises a second fastening structure as may be exemplified by VELCRO brand hook type fastening structure 26. As is well known in the art, hook type fastening structure is matable with loop type fastening structure and thereby may well function to prevent displacement of the attached components relative to one another when so mated. In this regard, it may be seen, for example, that when a cover construction outfitted with the second fastening structure 26, is used to cover a fastener 20 as received in an aperture 25 and is mated with the underlying first fastening structure 24, the cover construction is prevented from being displaced relative to the base member 10 via the fastened engagement.

At least one top attachable component is contemplated and exemplified by straight strap members 15, tie-type thong-like strap members 16, Y-type thong-like strap members 17, band-type strap members 18, or T-type strap members 19. Essentially, the top attachable component comprises first and second component ends (or attachment points) as at 29, which ends or attachment points 29 each preferably comprise an end aperture as at 30 and/or a third fastening structure as may be typified by the combination of both hook type fastening structure 26 and loop type fastening structure 24 respectively applied to a dual-sided structure.

In other words, it is contemplated that the third fastening structure may be exemplified by the combination of both hook and loop type fastening structures 26 and 24. The component or strap ends 29 are two-sided, and each side may be outfitted with a select fastening structure for mating with opposing fastening structure. In cases where the strap traverses the base member 10, it is contemplated that those portions traversing the base member 10 may also be outfitted with third fastening structure so as to improve the fastened engagement intermediate the strap member (or other top attachable component) and the base member 10.

For example, if the base member 10 is outfitted with loop type fastening structure 24, than a first side of the component end 29 may be outfitted with hook type fastening structure 26. Further, if the cover construction is outfitted with hook type fastening structure 26, then a second side of the component end 29 may be outfitted with loop type fastening structure 24. This general arrangement is illustrated and referenced in FIGS. 45 and 46.

Figure 47:
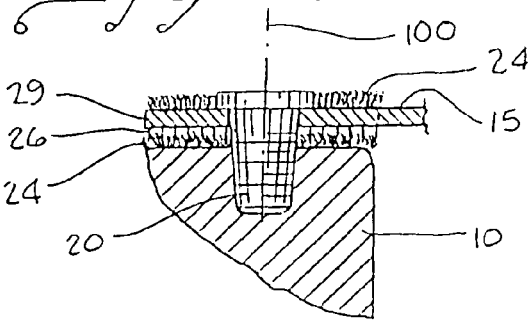
FIG. 47 is an enlarged, fragmentary side sectional view of a side section of the base member, the component end of the strap member, and fastener otherwise shown in FIG. 45 in fastened relation to one another.

Notably, from a review of the diagrammatic type depiction in FIG. 47, it may be seen that exemplary hooks 26 are mated with exemplary loops 24 through breakaway views in the component end 29. This mated attachment functions to prevent rotation of the component end 29 around axis 100, which axis 100 is coaxial with the fastener 20. The fastener 20, of course, prevents movement of the component end 29 axially relative to the fastener 20. The resulting fastened engagement of the component end 29 to the base member 10 is believed to provide a robust attachment point, which functions to durably resist the wear and tear of normal shoe usage.

Thus, the fasteners 20 fasten the first and second component ends 29 to the base member 10 via the end apertures 30 and fastener-receiving apertures 25. The cover construction selectively and removably covers (1) the first fastening structure, (2) the first and second component ends 29, and (3) the fasteners 20. The third fastening structure functions to prevent rotation of the first and second component ends 29 about axes such as 100 extending through (and coaxial with) the fasteners 20, and further functions to prevent displacement of the component ends 29 relative to the base member 10.

FIG. 1 is a top perspective view of a preferred, substantially planar base member construction or base member 10 according to the present invention showing three regions, namely a fore-foot region, a mid-foot region, and a rear-foot region, each region being visibly covered with a flap 11. Each flap 11 has a flap tab as at 28 and an opening or component aperture 27 is formed in the flap at the fore-foot region.

Figure 2:
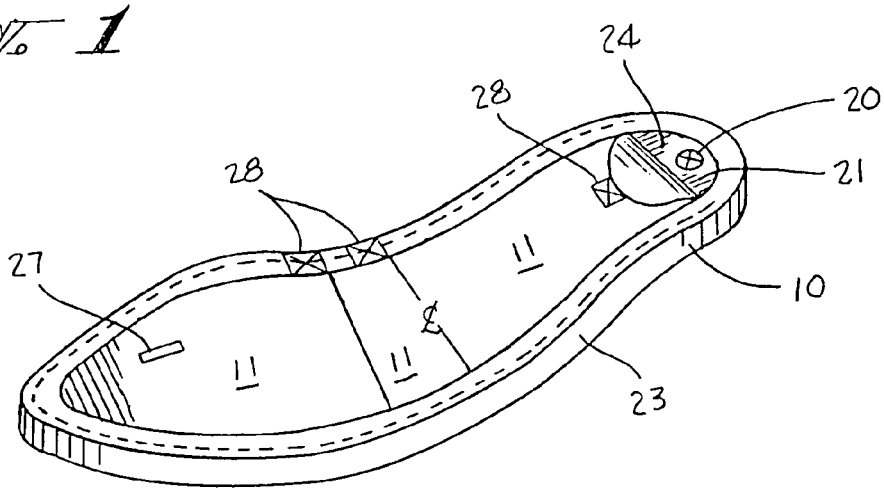
FIG. 2 is a top perspective view of the base member construction otherwise shown in FIG. 1 showing the flap at the rear-foot region being turned upward and toward the mid-foot region, thereby exposing an otherwise hidden portion of the underlying base member construction, the underlying base member construction comprising a fastener at the shoe rear.

FIG. 2 is a top perspective view of the base member construction 10 otherwise shown in FIG. 1 showing the flap 11 at the rear-foot region being turned upward and toward the mid-foot region, thereby exposing an otherwise hidden portion of the underlying base member construction, the underlying base member construction showing a threaded screw member or fastener 20 as received in a threaded aperture at the shoe rear.

Figure 3:
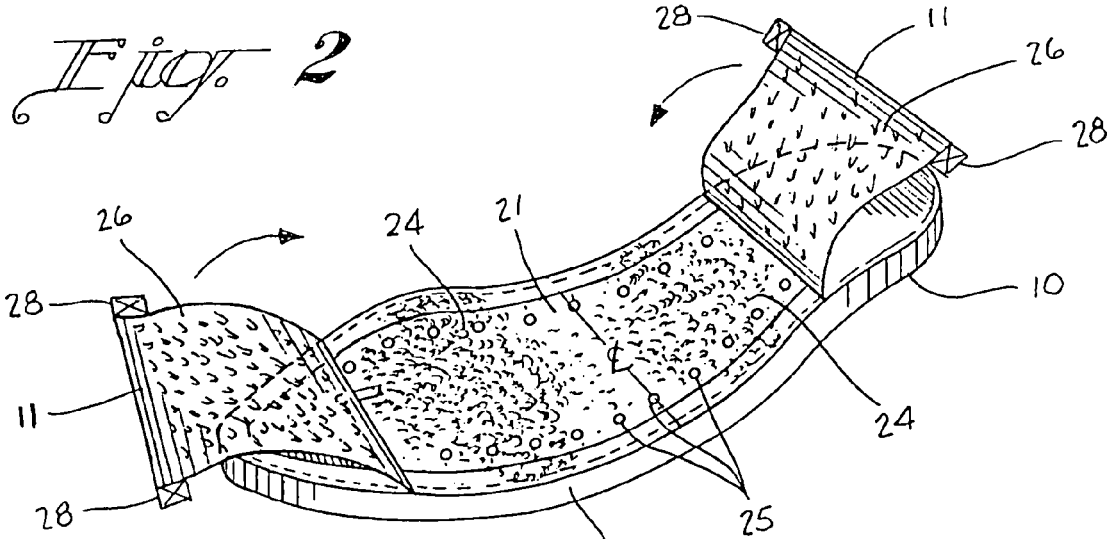
FIG. 3 is a top perspective view of the base member construction otherwise shown in FIG. 1 showing (1) the flap at the mid-foot region removed, (2) the flap at the fore-foot region being turned upward and toward the shoe front, and (3) the flap at the rear-foot region being turned upward and toward the shoe rear, thereby exposing otherwise hidden portions of the underlying base member construction, the underlying base member construction having peripherally arranged apertures orthogonal to the base member construction.

FIG. 3 is a top perspective view of the base member construction 10 otherwise shown in FIG. 1 showing (1) the flap 11 at the mid-foot region removed, (2) the flap 11 at the fore-foot region being turned upward and toward the shoe front, and (3) the flap 11 at the rear-foot region being turned upward and toward the shoe rear, thereby exposing otherwise hidden portions of the underlying base member construction 10. The underlying base member construction 10 notably has peripherally arranged fastener-receiving apertures 25 as exemplified by threaded apertures, which are axially orthogonal to the top surface 21 of the base member construction 10.

Figure 4:
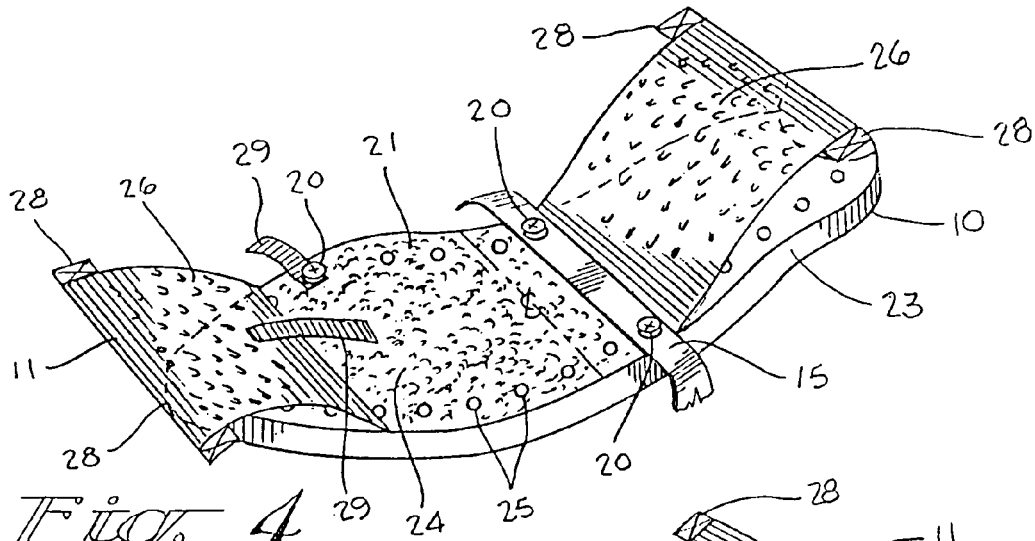
FIG. 4 is a top perspective view of the base member construction otherwise shown in FIG. 3 showing a first set of strap ends being attached to the underlying base member construction at the fore-foot region and a strap midsection being attached to the underlying base member construction at the rear-foot region.

FIG. 4 is a top perspective view of the base member construction 10 otherwise shown in FIG. 3 showing a first set of strap or component ends 29 being attached to the underlying base member construction 10 at the fore-foot region and a circular-type strap midsection being attached to the underlying base member 10 construction at the rear-foot region via two attachment points 29, apertures 30, apertures 25, and fasteners 20.

Figure 5:
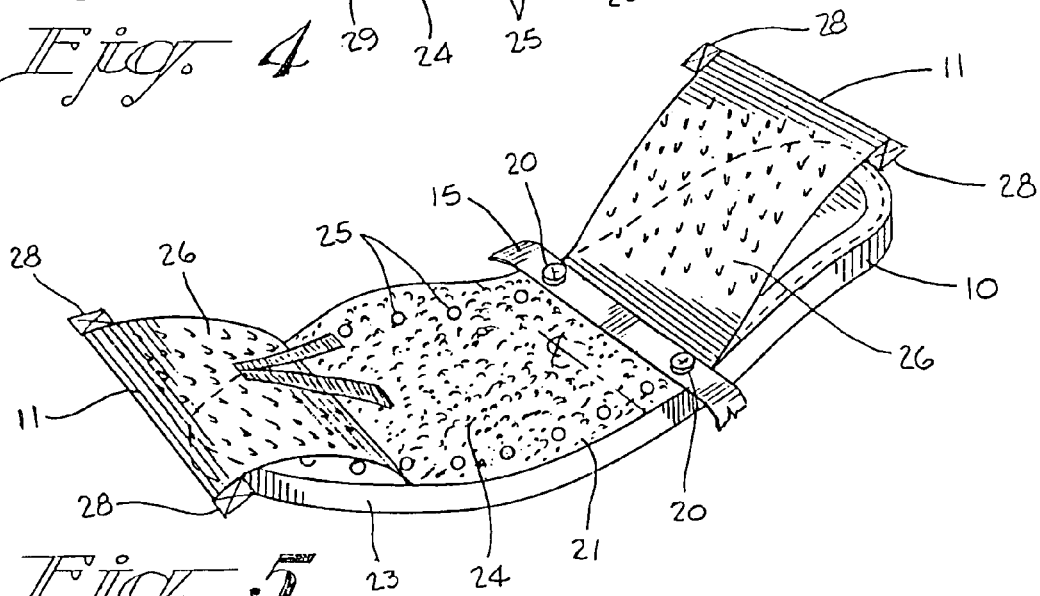
FIG. 5 is a top perspective view of the base member construction otherwise shown in FIG. 3 showing a second set of strap ends being attached to the underlying base member construction at the fore-foot region a strap midsection being attached to the underlying base member construction at the rear-foot region.

FIG. 5 is a top perspective view of the base member construction 10 otherwise shown in FIG. 3 showing a second set of strap or component ends or attachment points 29 being attached to the underlying base member construction 10 at the fore-foot region a midsection of a strap member 15 being attached via fasteners 20 and apertures 25 and 30 to the underlying base member construction 10 at the rear-foot region.

Figure 6:
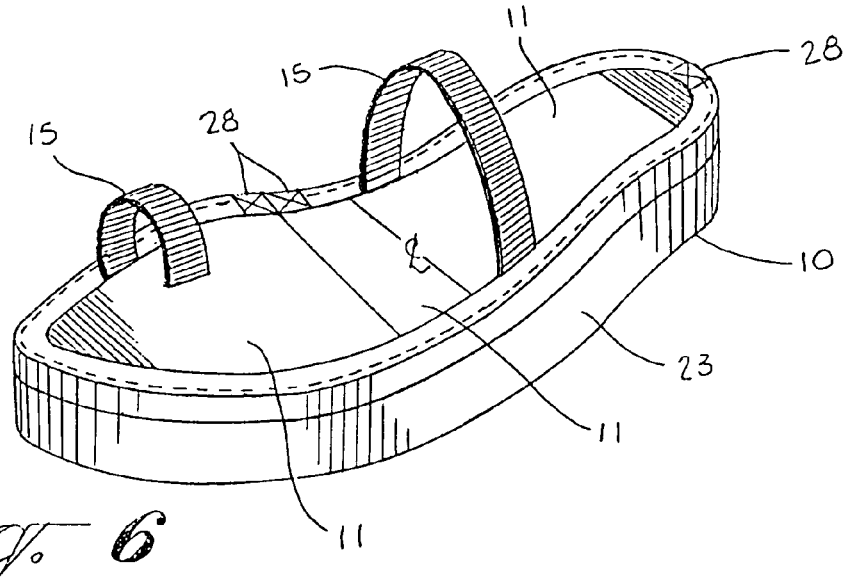
FIG. 6 is a top perspective view of a shoe construction showing the flaps repositioned and attached over the underlying base member construction thereby concealing the loop construction and fastener-receiving apertures and showing an exposed toe strap and mid-foot strap.

FIG. 6 is a top perspective view of a shoe construction showing the flaps 11 repositioned and attached over the underlying base member construction 10 thereby concealing the loop construction 24 and apertures 25 and showing an exposed toe strap 15 and mid-foot strap 15. It is contemplated that the straps 15 may be adjusted upward or downward by moving the ends thereof medially or laterally as needed and then applying cover construction thereover. Thus, it is contemplated that the strap construction may be made as a one-size-fits-all type shoe construction.

FIG. 7 is a top perspective view of a shoe construction showing the flaps 11 repositioned and attached over the underlying base member construction 10 thereby concealing the loop type fastener structure 24 and fastener-receiving apertures 25 and showing an exposed tie-type, thong-like strap construction 16 extending from the fore-foot region to the rear-foot region. FIG. 7(*a*) is a top perspective view of the tie-type, thong-like strap construction 16 otherwise depicted in FIG. 7 as exploded from the shoe construction.

FIG. 8 is a top perspective view of an alternative embodiment of the shoe construction according to the present invention showing a fore-foot flap 11 turned upward and toward the shoe front and a rear-foot flap 11 turned upward and toward the shoe rear thereby exposing a relatively thickened peripheral surface 23 or underlying shoe construction as compared to the peripheral surface 23 of the shoe construction shown in FIG. 1.

Notably, the peripheral surface 13 in FIG. 8 comprises a side-type cover strip 13, may extend the entire periphery or be broken up into sections. The outside of strip 13 may be preferably outfitted with loop type fastening structure 24 to which may be applied any number of adornments (not specifically shown) via hook type fastening structure 26. The strip 13 allows for adornments of different sizes, a change in color of base or for straps to attach to it (e.g. band straps or straps that are made to encompass that part of the base (not specifically shown)).

When the sole is constructed this way, the strip 13 does not pull away but an additional strip may be placed over the strip 13 to embellish or to conceal the fastening apertures or the VELCRO brand hook or loop fastening structure. It is contemplated that this strip is ideal for thick bases including platform and wedge shoes—extending onto the heel. Further, the top surface 21, while preferably outfitted with loop type fastening structure, may alternatively be outfitted with hook type fastening structure, it being noted that the flaps 11 must comprise the mating fastener construction. The hook and loop type fastening structures 26 and 24 may be preferably stitched or adhesively applied to their respective underlying structures.

FIG. 9 is a top perspective view of the shoe construction otherwise shown in FIG. 8 showing the fore-foot flap 11 and rear-foot flap 11 repositioned and attached over the loop type fastening structure 24 of the underlying base member construction 10 thereby concealing the loop construction 24 and showing an opening 27 formed in the flap 11 at the fore-foot region. Further, the side-type cover strip 13 has been removed to show underlying fastener-receiving apertures 25 formed in the periphery of the shoe construction, the axes of which are parallel to the plane of the top and bottom surfaces 21 and 22.

Figure 10:
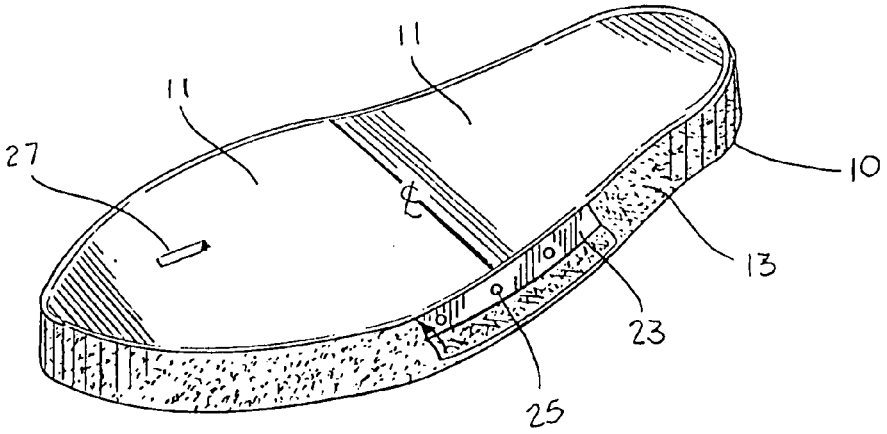
FIG. 10 is a top perspective view of the shoe construction otherwise shown in FIG. 9 showing the peripheral cover reattached with parts broken away to show underlying apertures formed in the periphery of the shoe construction parallel to the plane of the surface of the underlying shoe construction.

FIG. 10 is a top perspective view of the shoe construction otherwise shown in FIG. 9 showing the side-type cover strip 13 reattached with parts broken away to show underlying fastener-receiving apertures formed in the periphery or peripheral surface 23 of the base member 10, the axes of which are parallel to the plane of the top and bottom surfaces 21 and 22 of the underlying shoe construction.

Figure 11:
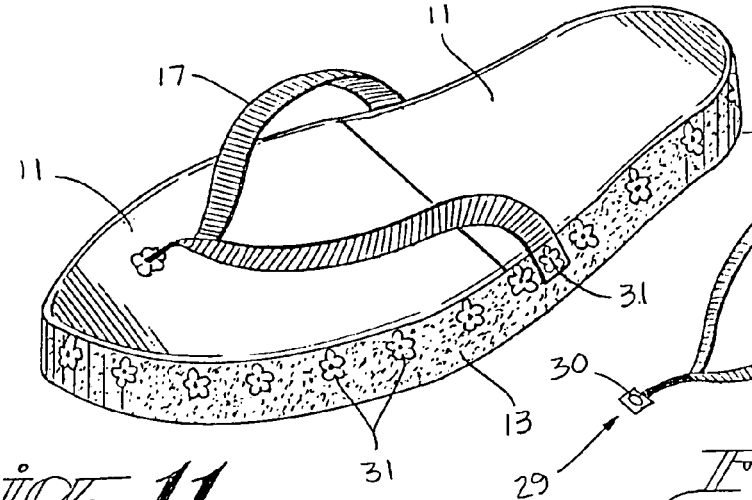
FIG. 11 is a top perspective view of the shoe construction otherwise shown in FIG. 9 showing (1) the peripheral cover reattached with a series of ornamental inserts peripherally attached to the peripheral cover, and (2) a thong-like strap construction attached to the shoe construction extending from the fore-foot region toward the rear-foot region.
Figure 11A:
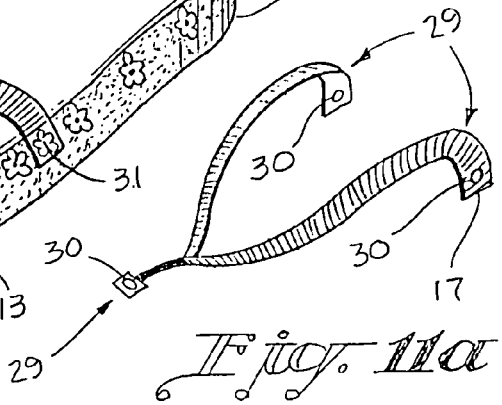
Figure 12:
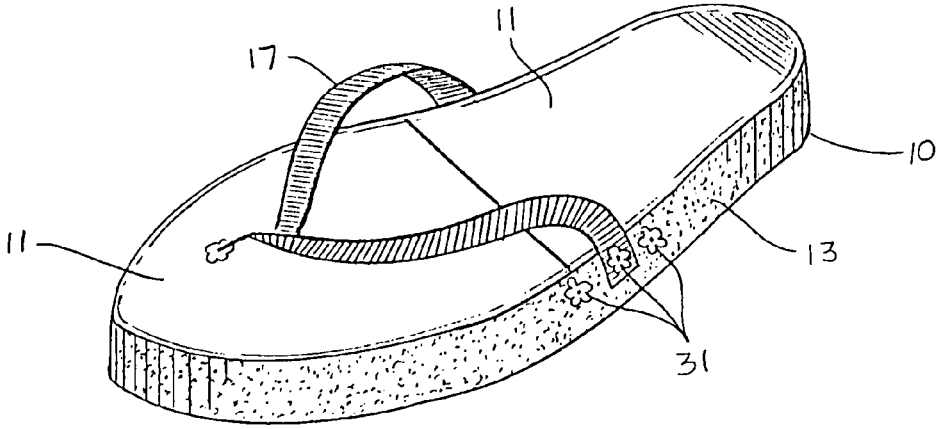
FIG. 12 is a top perspective view of the shoe construction otherwise shown in FIG. 9 showing (1) the peripheral cover reattached with a series of ornamental inserts attached to a section the peripheral cover, and (2) a thong-like strap construction attached to the shoe construction extending from the fore-foot region toward the rear-foot region.

FIGS. 11 and 12 are top perspective views of the shoe construction otherwise shown in FIG. 9 showing the side-type cover strip 13 reattached with a series of ornamental inserts 31 peripherally attached thereto (e.g. via the fastener-receiving apertures 25 and male structure of the inserts 31 or via hook and loop type fastening structure). Further, FIG. 11 depicts a Y-type, thong-like strap construction 17 as attached to the shoe construction extending from the fore-foot region toward the rear-foot region. It may be noted that one insert 31 is shown attaching an end 29 of the construction 17 to the shoe construction via aperture 30 and aperture 25 as comparatively depicted in FIGS. 11 and 11(*a*).

Figure 13:
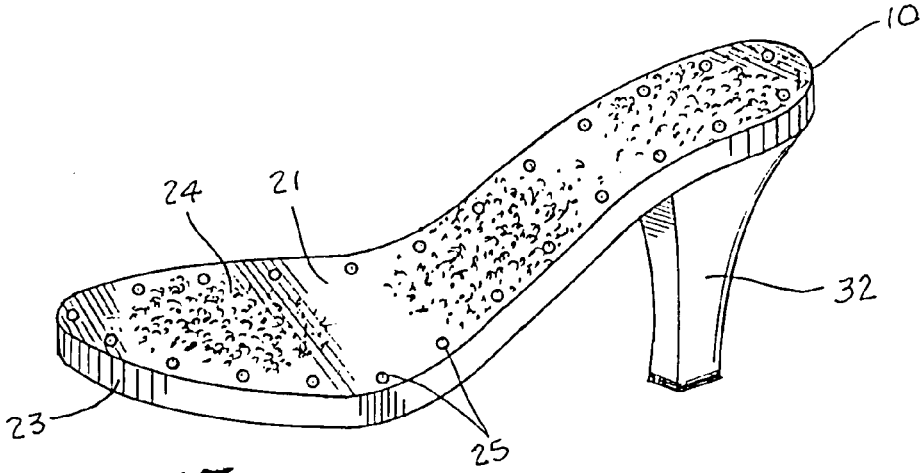
FIG. 13 is a top perspective view of an alternative shoe construction showing a base member and a heel member attached to the base member, the base member having peripheral apertures orthogonal to the plane of the base member.
Figure 13A:
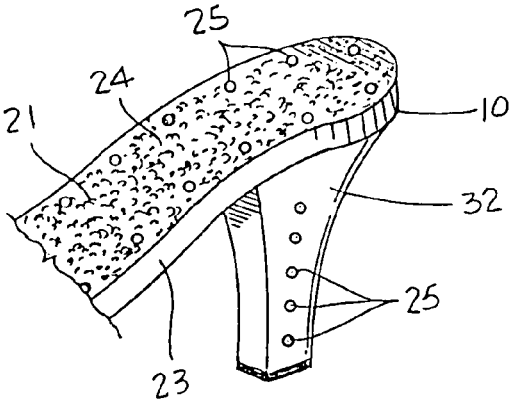
Figure 13B:
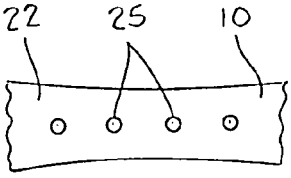

FIG. 13 is a top perspective view of an alternative shoe construction showing a base member 10 and a bottom-attachable component such as a heel member 32 or heel assembly attached to the base member 10. In this regard, it is contemplated that the base member 10 may further preferably comprise male of female structure (not specifically illustrated) orthogonal to the plane of the bottom surface 22 for cooperably mating with female structure 33 or male structure 34 of the heel assembly 32 as typified in FIGS. 19 and 21. FIG. 13(*a*) is a fragmentary top perspective view of an alternative shoe construction showing a fragmentary base member 10 and a heel member 32 having optional fastener-receiving apertures orthogonal to the axis of the heel member 32. FIG. 13(*b*) is a fragmentary bottom view of the base member 10 otherwise depicted in FIG. 13 showing medially aligned threaded apertures 25 along the bottom surface 22 of the base member 10.

Figure 14:
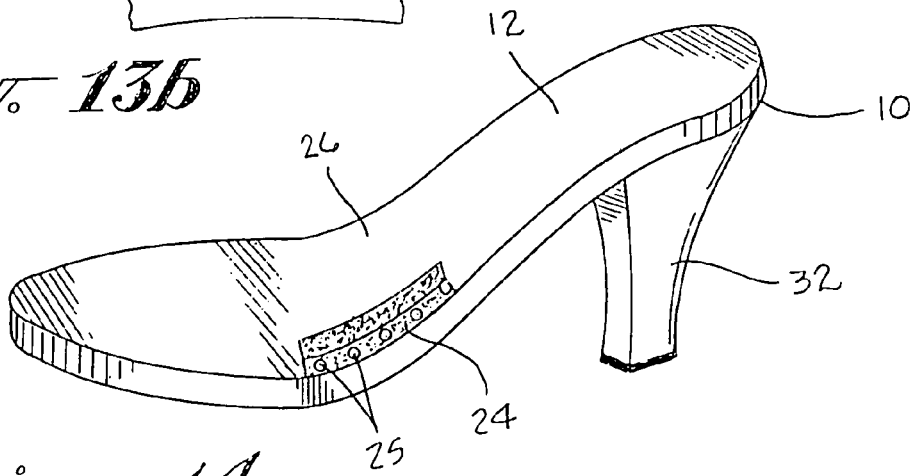
FIG. 14 is a top perspective view of an alternative shoe construction showing a base member, a heel member attached to the base member, and a base member cover, the base member cover being upturned at one section to show peripheral apertures formed in the underlying base member construction orthogonal to the plane of the base member.

FIG. 14 is a top perspective view of an alternative shoe construction showing a base member 10, a heel member 32 attached to the base member 10, and a base member cover construction such as a one-piece top-type cover strip 12. The base member cover construction shown in FIG. 14 has been upturned at one section to show peripheral fastener-receiving apertures 25 formed in the underlying base member construction orthogonal to the top surface 21 of the base member 10.

FIG. 15 is a top perspective view of an alternative shoe construction showing a base member 10, a heel member 32 attached to the base member 10, and an upper-type strap member 14 attached to the base member 10. The base member 10 comprises peripheral fastener-receiving apertures 25 parallel to the plane of the top and bottom surfaces 21 and 22, and the strap member comprises external loop fastening structure 24.

FIG. 15(*a*) is a top perspective view of a band-type strap member cover 35 exploded from the strap member 14 otherwise depicted in FIG. 15, which strap member cover 35 comprises hook fastening structure 26 for attachment to the strap member 14 and apertures 30 for cooperable attachment to the base member 10 via fasteners 20 (not specifically illustrated).

Figure 16B:
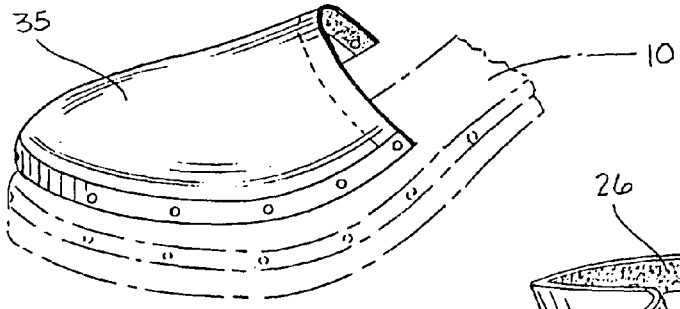
FIG. 16 is a top perspective view of an alternative shoe construction showing a base member, a heel member attached to the base member, a base member cover, and a strap member exploded from the base member and base member cover, the base member being outfitted with peripheral apertures orthogonal to the plane of the base member as exposed by an upturned portion of the base member cover.

FIG. 16 is a top perspective view of an alternative shoe construction showing a base member 10, a heel member 32 attached to the base member 10, a base member cover construction as top-type cover strip 12, and a band-type strap member 18 exploded from the base member 10 and base member cover 12. The base member 10 is outfitted with peripheral fastener-receiving apertures 25 orthogonal to the plane of the top and bottom surfaces 21 and 22 as exposed by an upturned portion of the base member cover construction or strip 12. FIG. 16(*a*) is a fragmentary top perspective view of a front portion of the shoe construction otherwise depicted in FIG. 16 showing a fastener-receiving aperture 25 as exposed by an upturned section of the base member cover construction or strip 12.

Figure 17A:
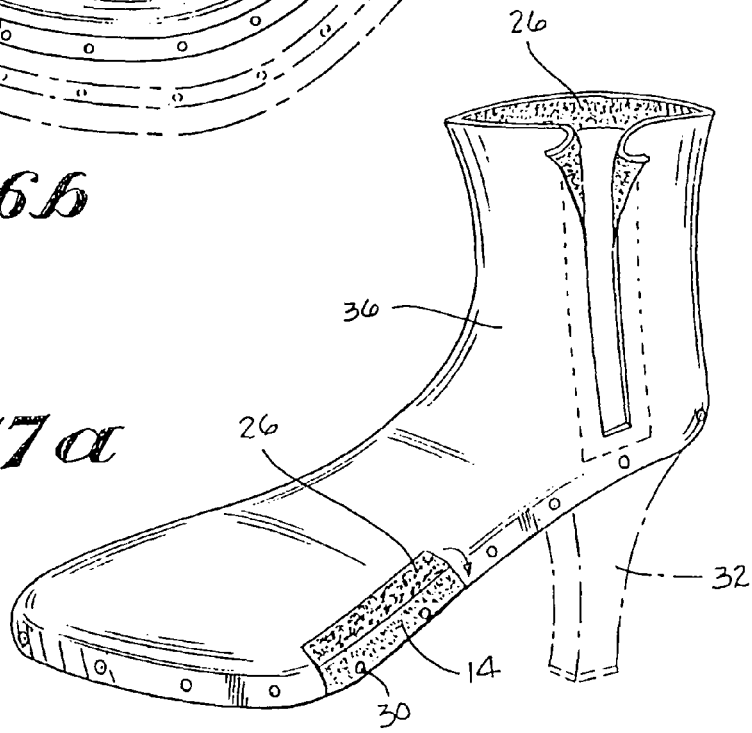
FIG. 17 is a top perspective view of an alternative base shoe assembly according to the present invention showing a base member, a heel member attached to the base member, and an upper member attached to the base member, the upper member (1) being upturned at one section thereof to show underlying peripheral apertures parallel to the plane of the base member, and (2) comprising exterior loop fastening structure.
Figure 17B:
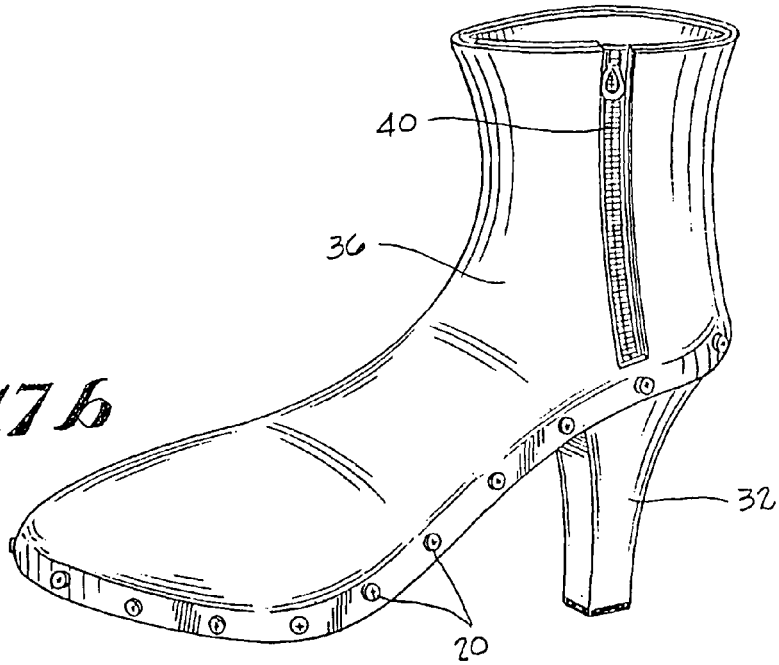

FIG. 17 is a top perspective view of an alternative base shoe assembly showing a base member 10, a heel member 32 attached to the base member 10 and an upper-type cover member 14 attached to the base member 10. The upper-type cover member 14 is depicted as upturned at one section thereof to show underlying peripheral fastener-receiving apertures 25 parallel to the plane of the top and bottom surfaces 21 and 22, and further comprising exterior loop fastening structure 24. A zipper 40 may be incorporated into cover member 14 so as to ease the donning and removal thereof.

The attached upper 14 on the boot is made with a cover strip at the base of the boot. It pulls downward allowing for a cover to slip into it and attach (not specifically shown). The strip may be made in different heights depending on the shoe base and it may extend over the upper portion of the boot or shoe. When the cover strip is ½ inch or bigger, the screw type fastener is not needed on that base if preferred. It is contemplated that the VELCRO brand hook and loop type fastening structure around the perimeter will suffice to keep the upper secure.

FIG. 17(*a*) is a top perspective view of an alternative shoe construction according to the present invention showing an upper-type cover member 14, a heel member 32, and an upper member 36 attached to the cover member 14. It may be seen from an inspection of the noted figure that the upper member 36 is upturned at one section thereof to show underlying peripheral fastener-receiving apertures parallel to the plane of the base member (hidden by cover member 14). Further, the upper member 36 comprises interior hook-type fastening structure 26.

FIG. 17(*b*) is a top perspective view of an alternative shoe construction according to the present invention showing the upper member 36 (concealing the upper-type cover member 14) and a heel member 32. The upper member 36 is attached to the upper-type cover member 14 via matable hook and loop fastening structures 26 and 24, and peripheral fastener-receiving apertures 25 and fasteners 20 substantially parallel to the plane of the base member 10. A zipper 40 may be incorporated into upper member 36 so as to ease the donning and removal thereof.

Figure 18A:
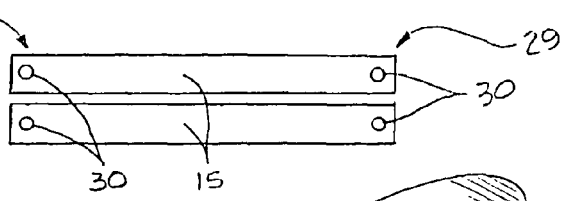
FIG. 18 is a top perspective of an alternative shoe construction according to the present invention showing a base member, a base member cover attached to the base ember, a first, three-piece heel construction attached to the base member and two strap member attached to both the base member and base member cover.
Figure 18:
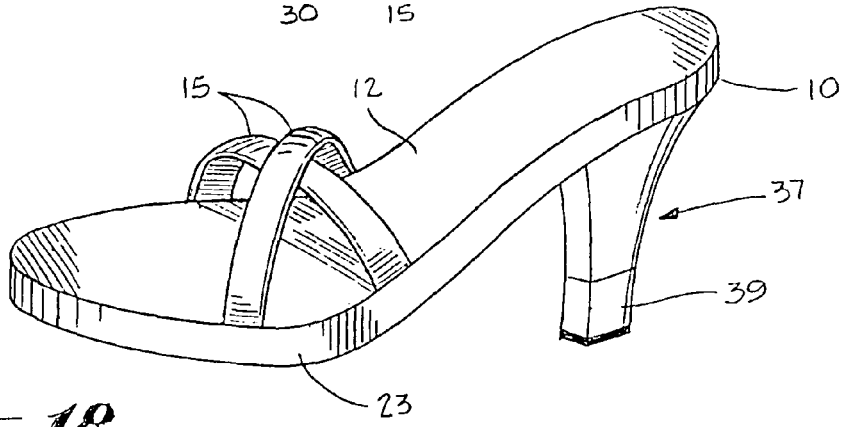

FIG. 18 is a top perspective of an alternative shoe construction according to the present invention showing a base member 10, a top-type cover strip 12 attached to the base ember 10, a first, three-piece heel construction 37 attached to the base member 10 and two strap members 15 attached to both the base member 10 and base member cover strip 12. FIG. 18(*a*) depicts plan views of the strap members 15 otherwise depicted in FIG. 18.

Figure 19:
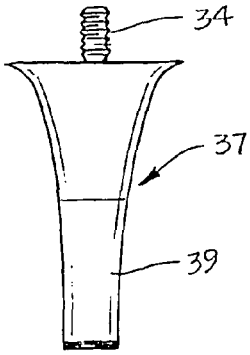
FIG. 19 is a side view of the first heel construction otherwise depicted in FIG. 18.
Figure 20:
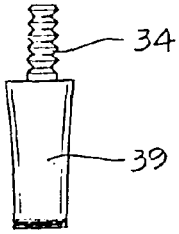
FIG. 20 is a side view of the bottom two portions of the three-piece heel construction otherwise depicted in FIG. 19 showing a fastener extending upward from the top most portion.
Figure 21:
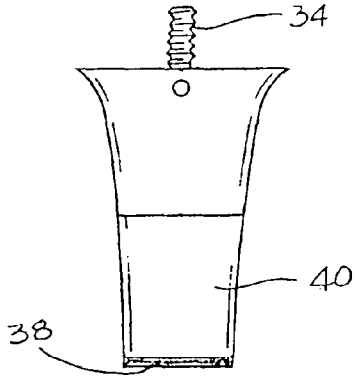
FIG. 21 is a side view of a second, three-piece heel construction relatively thicker in girth as compared to the first heel construction otherwise depicted in FIGS. 18 and 19.

FIG. 19 generally depicts the heel construction 37 otherwise depicted in FIG. 18. FIG. 20 is a side view of the bottom two portions of the three-piece heel construction 37 otherwise depicted in FIG. 19 showing a threaded fastener 38 extending upward from the top most portion 39. Threaded fastener 34 is believed equivalent to male structure 34 otherwise depicted in FIG. 19. FIG. 21 is a side view of a second, three-piece heel construction relatively thicker in girth as compared to the first heel construction 37 otherwise depicted in FIGS. 18 and 19.

Figure 24:
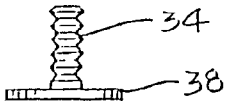
FIG. 24 is a side view of a bottom most portion of the second heel construction otherwise depicted in FIG. 21 showing a fastener extending upward therefrom.
Figure 23:
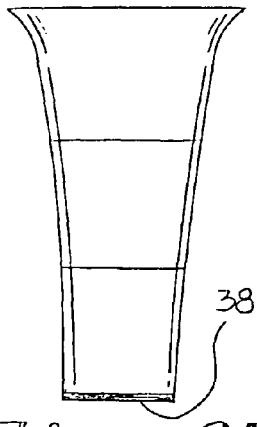
FIG. 23 is a side view of a third, four-piece heel construction relatively longer in construction as compared to the second heel construction otherwise depicted in FIG. 21.
Figure 22:
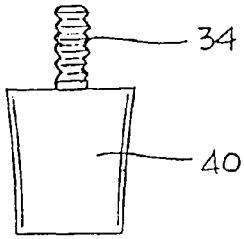
FIG. 22 is a side view of the middle portion of the heel construction otherwise depicted in FIG. 21 showing a fastener extending upward therefrom.

FIG. 22 is a side view of the middle portion of the heel construction otherwise depicted in FIG. 21 showing a threaded fastener 34 extending upward therefrom. FIG. 23 is a side view of a third, four-piece heel construction relatively longer in construction as compared to the second heel construction otherwise depicted in FIG. 21. FIG. 24 is a side view of a bottom most portion of the second heel construction otherwise depicted in FIG. 21 showing a threaded fastener extending upward therefrom. The male structures 34 mate with female structures substantially equivalent to structure 33, although the same have not been specifically illustrated. Male structures 34 thus exemplify threaded bottom attachable Component structure of the bottom attachable component or heel member 32; and female structure(s) 33 thus exemplify threaded bottom surface structure of the bottom surface 22.

It is contemplated that the heel construction(s) may be constructed in one-inch lengths up to five inches in length. Further, it is contemplated that all of the soles or base members 10 may be made to receive any type of heel construction so as to provide a wedge type, a flat type, or a stack type shoe construction. For example, if the wearer is tired of walking on a four-inch heel construction, the wearer may remove the heel construction or parts thereof as needed to increase the comfort level. The heel constructions may also be provided in a plurality of colors. Further, the heels may be outfitted with VELCRO brand hook or loop type fastening structure allowing the user to interchange covers (not specifically shown). It is contemplated that this feature will be ideal for platform and wedge type shoes and any heel of any thickness.

Figure 25:
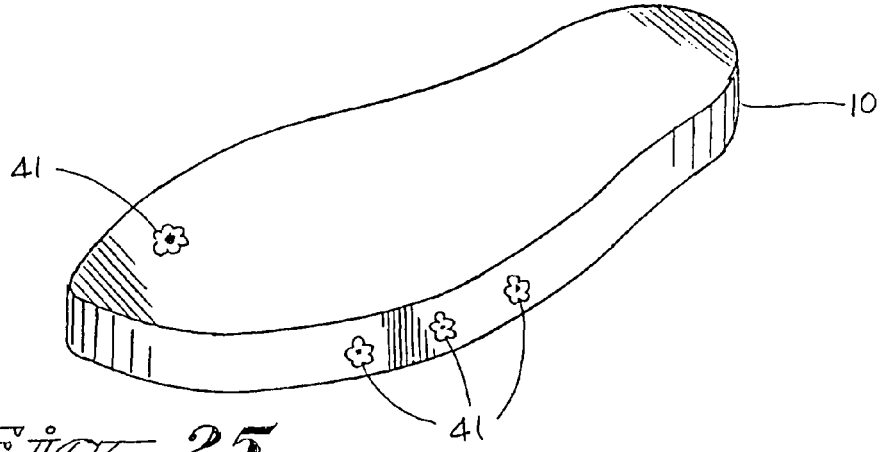
FIG. 25 is a top perspective view of an alternative shoe construction according to the present invention showing three ornamental screws operably received on the side of the shoe construction and one ornamental screw operably received on the front-top of the shoe construction.
Figure 26:
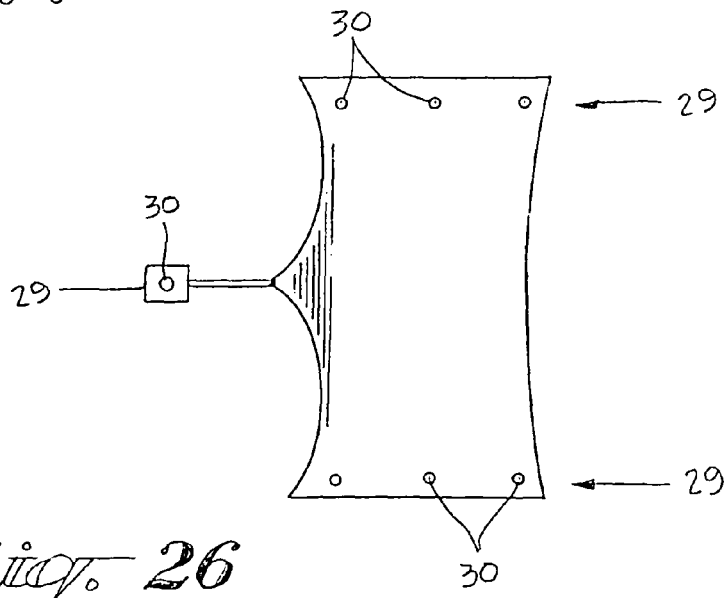
FIG. 26 is a top plan type depiction of a strap member otherwise attachable to the shoe construction shown in FIG. 25.
Figure 27:
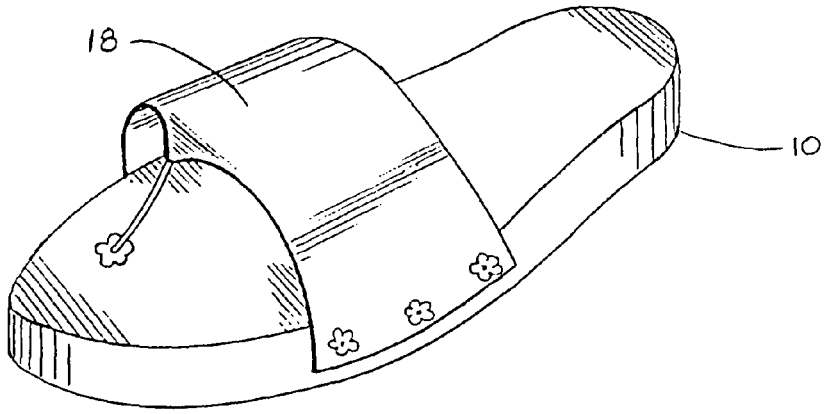
FIG. 27 is a top perspective view of the shoe construction otherwise shown in FIG. 25 as outfitted with the strap member otherwise shown in FIG. 26, the ornamental screws being utilized to fasten the strap member to the shoe construction.

FIG. 25 is a top perspective view of an alternative shoe construction according to the present invention showing three ornamentally-headed screws 41 operably received on the side of the shoe construction and one ornamental screw 41 operably received on the front-top of the shoe construction. FIG. 26 is a top plan type depiction of a band-type strap member 18 otherwise attachable to the shoe construction shown in FIG. 25. FIG. 27 is a top perspective view of the shoe construction otherwise shown in FIG. 25 as outfitted with the strap member 18 otherwise shown in FIG. 26, the ornamental screws 41 being utilized to fasten the strap member 18 to the shoe construction.

Figure 28:
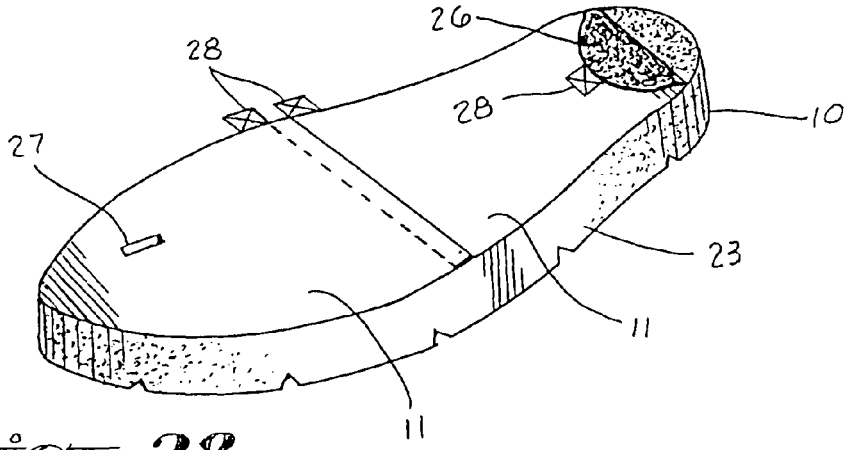
FIG. 28 is a top perspective view of an alternative shoe construction according to the present invention showing a base member with first and second flaps covering the fore-foot and rear-foot regions, the flap at the rear-foot region being upturned to show otherwise hidden structure.

FIG. 28 is a top perspective view of an alternative shoe construction according to the present invention showing a base member 10 with first and second flaps 11 covering the fore-foot and rear-foot regions. It may be seen from an inspection of the figure that the flap 11 at the rear-foot region is upturned to show otherwise hidden structure, namely loop type fastening structure 24 and hook type fastening structure 26.

Figure 29:
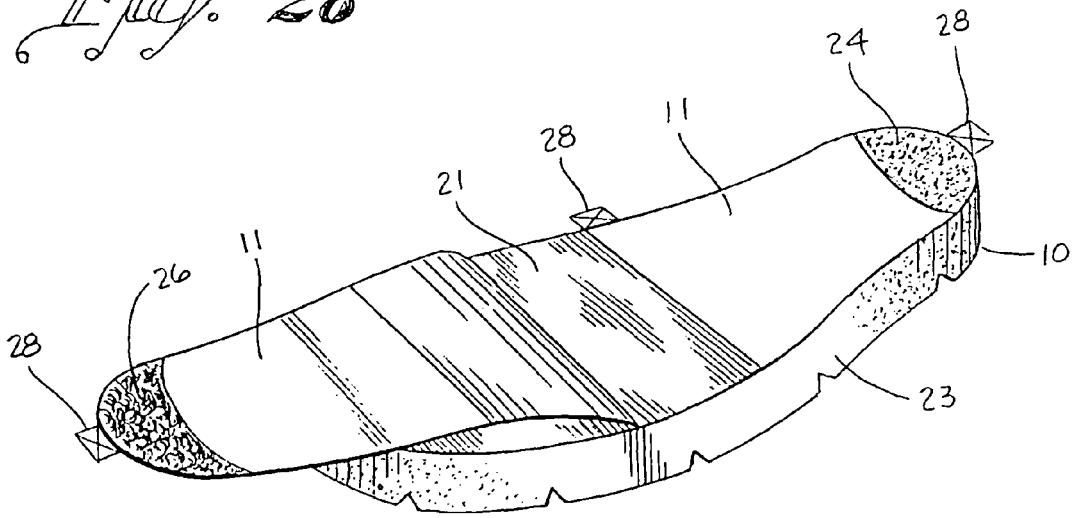
FIG. 29 is a top perspective of an alternative shoe construction according to the present invention showing a base member with first and second flaps covering the fore-foot and rear-foot regions, the first flap at the rear-foot region comprising loop type fastening structure and the second flap being upturned to show hook type fastening structure for mated attachment to the loop type fastening structure of the first flap at the rear-foot region.

FIG. 29 is a top perspective of an alternative shoe construction according to the present invention showing a base member 10 with first and second flaps 11 covering the fore-foot and rear-foot regions. The first flap 11 at the rear-foot region comprises loop type fastening structure 24 and the second flap 11 at the fore-foot region is upturned to show hook type fastening structure 26 for mated attachment to the loop type fastening structure 24 of the first flap 11 at the rear-foot region.

Figure 30:
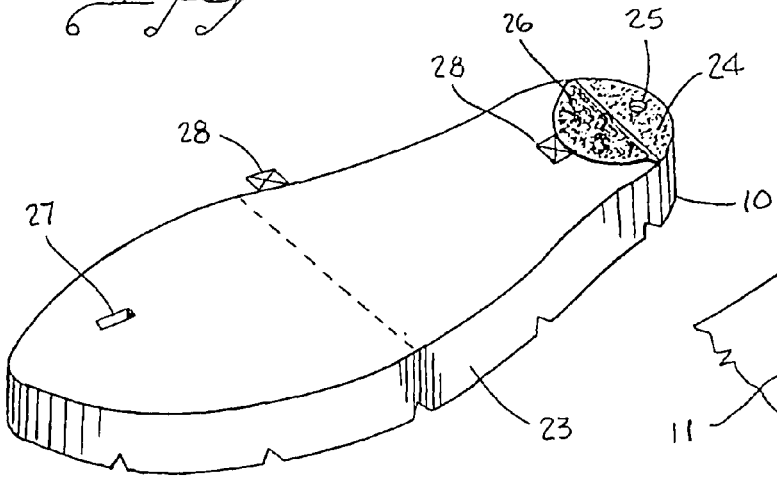
FIG. 30 is a top perspective view of the alternative shoe construction otherwise shown in FIG. 29 showing the first flap being upturned at the rear-foot region to show hook and look fastening structure and an aperture formed in the base member at the rear-foot region.
Figure 31:
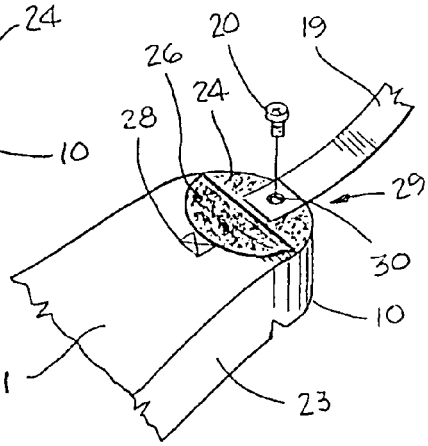
FIG. 31 is a fragmentary top perspective view of the rear portion of the shoe construction otherwise depicted in FIG. 30 showing a fragmentary strap being screw fastened to the aperture otherwise shown in FIG. 30.

FIG. 30 is a top perspective view of the alternative shoe construction otherwise shown in FIG. 29 showing the first flap 11 being upturned at the rear-foot region to show the hook and look fastening structures 26 and 24 and a fastener-receiving aperture 25 formed in the base member 10 at the rear-foot region. FIG. 31 is a fragmentary top perspective view of the rear portion of the shoe construction otherwise depicted in FIG. 30 showing a fragmentary strap end 29 being screw fastened to the fastener-receiving aperture otherwise shown in FIG. 30.

Figure 32:
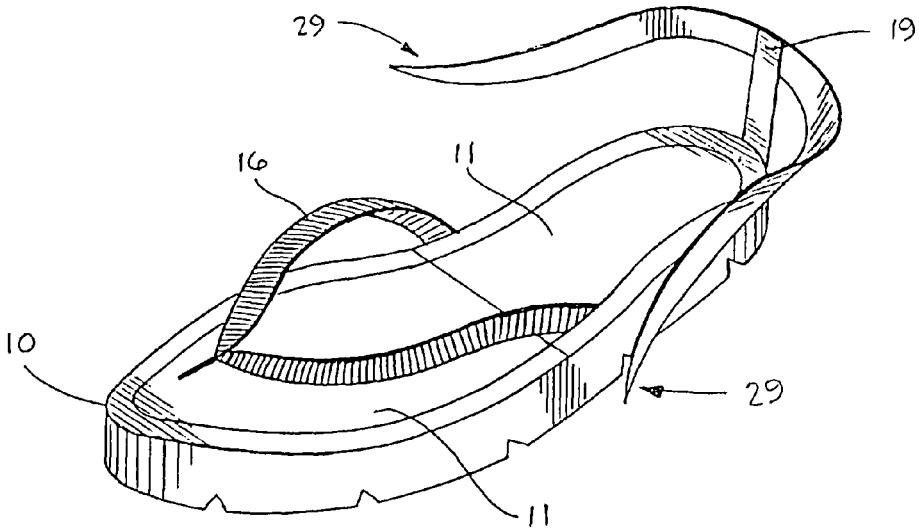
FIG. 32 is a top perspective view of an alternative shoe construction according to the present invention showing a thong-like strap member and a heel or T-type strap member attached to the base member.
Figure 33:
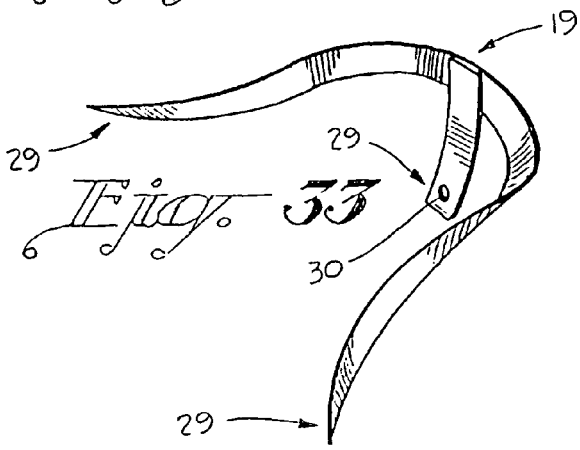
FIG. 33 is a top perspective view of the heel strap member otherwise shown in FIG. 32.
Figure 34:
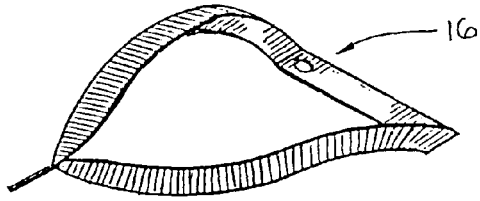
FIG. 34 is a top perspective view of the thong-like strap member otherwise shown in FIG. 32.

FIG. 32 is a top perspective view of an alternative shoe construction according to the present invention showing a tie-type, thong-like strap member 16 and a T-type strap member 19 attached to the base member 10. FIG. 33 is a top perspective view of the T-type strap member 19 otherwise shown in FIG. 32 and FIG. 34 is a top perspective view of the tie-type, thong-like strap member 16 otherwise shown in FIG. 32.

Figure 35:
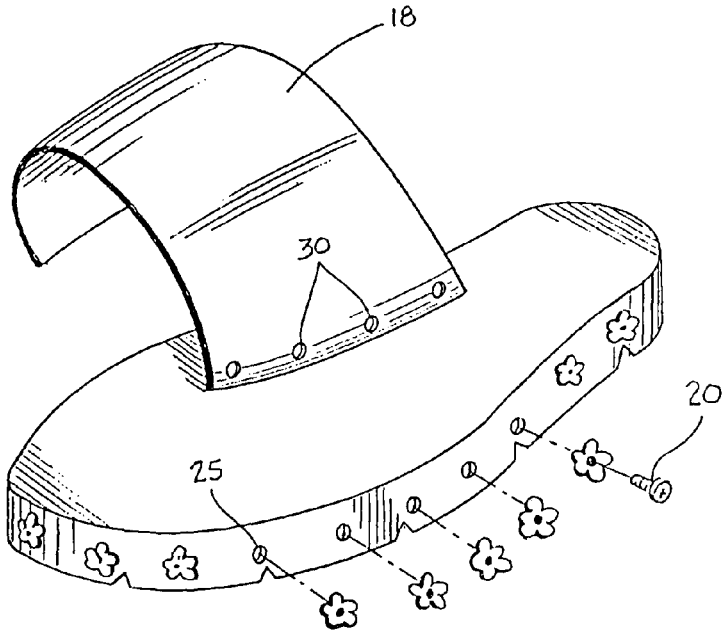
FIG. 35 is a top perspective view of an alternative shoe construction according to the present invention showing a strap member exploded from a base member and being attached thereto via a series of ornamental screw assemblies, which screw assemblies are cooperable with peripheral apertures formed in and parallel to the plane of the base member.
Figure 36:
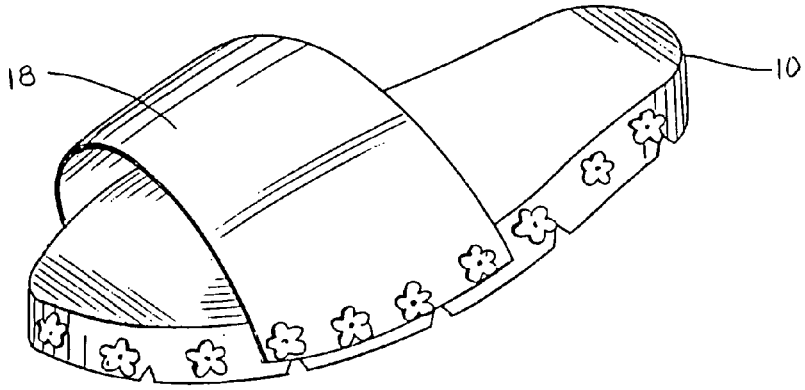
FIG. 36 is a top perspective view of the alternative shoe construction otherwise shown in FIG. 35 showing the strap member attached to the base member via the ornamental screw assemblies.

FIG. 35 is a top perspective view of an alternative shoe construction according to the present invention showing a band type strap member 18 exploded from a base member 10 and being attached thereto via a series of ornamental screw assemblies, which screw assemblies are cooperable with peripheral fastener-receiving apertures 25 formed in (and parallel to) the plane of the base member 10. FIG. 36 is a top perspective view of the alternative shoe construction otherwise shown in FIG. 35 showing the strap member 18 attached to the base member 10 via the ornamental screw assemblies.

Figure 37:
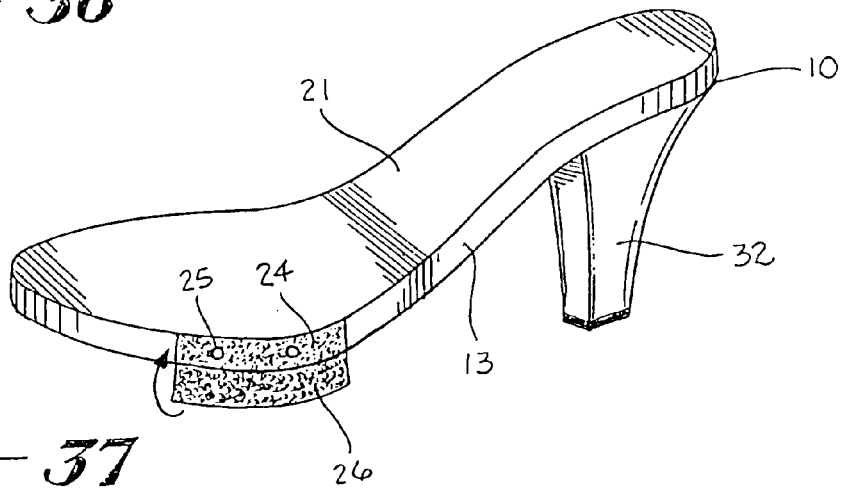
FIG. 37 is a top perspective view of an alternative shoe construction showing a base member, a heel member, and a base cover strip, which base cover strip has been folded away at a section thereof to expose (1) peripheral apertures extending parallel to the plane of the base member, and (2) loop type fastening structure on the peripheral edge of the base member.
Figure 38:
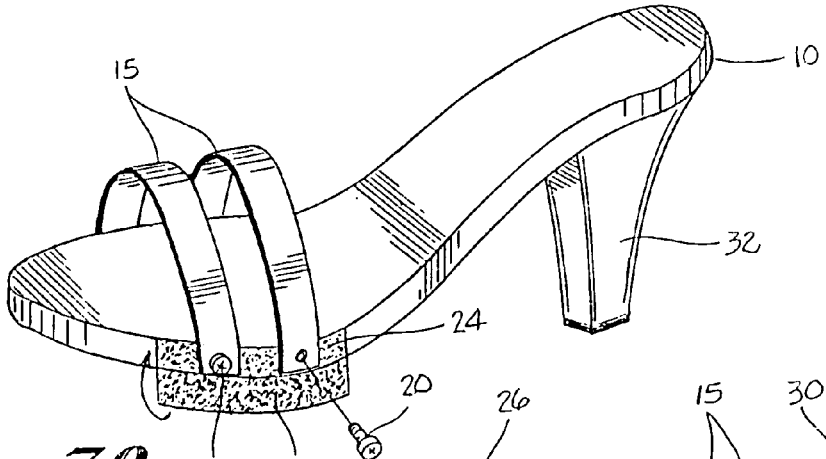
FIG. 38 is a top perspective view of the alternative shoe construction otherwise shown in FIG. 37 showing two strap members being attached to the base member via the folded away base cover strip and fasteners.

FIG. 37 is a top perspective view of an alternative shoe construction showing a base member 10, a heel member 32, and a side-type base cover strip 13. The base cover strip 13 has been folded away in FIG. 37 at a section thereof to expose (1) peripheral fastener-receiving apertures 25 extending parallel to the plane of the base member 10, and (2) loop type fastening structure 24 on the peripheral surface 21 of the base member 10. FIG. 38 is a top perspective view of the alternative shoe construction otherwise shown in FIG. 37 showing two strap members 15 being attached to the base member 10 via the folded away base cover strip 13 and threaded fasteners 20.

Figure 39:
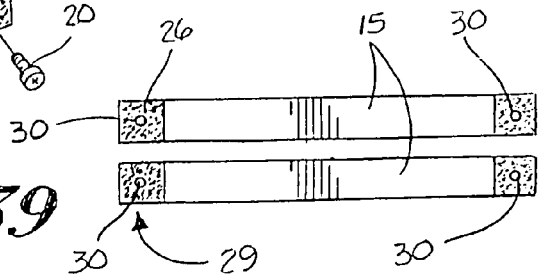
FIG. 39 is a plan type depiction of the two strap members otherwise depicted in FIG. 38 showing ends of the straps with fastener-receiving apertures and hook type fastening structure.
Figure 40:
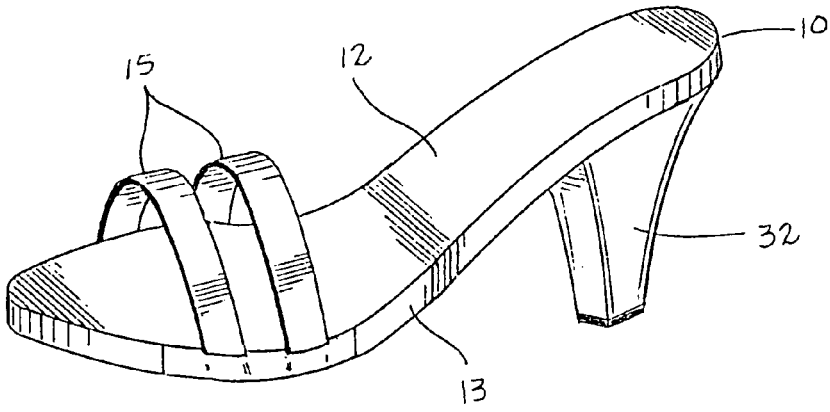
FIG. 40 is a top perspective view of the alternative shoe construction otherwise shown in FIGS. 37 and 38 showing two strap members attached to the base member and the base cover strip repositioned so as to cover the ends of the strap members.

FIG. 39 is a plan type depiction of the two strap members 15 otherwise depicted in FIG. 38 showing ends 29 of the straps outfitted with fastener-receiving apertures 30 and hook type fastening structure 26. FIG. 40 is a top perspective view of the alternative shoe construction otherwise shown in FIGS. 37 and 38 showing two strap members 15 attached to the base member 10 and the base cover strip 13 repositioned so as to cover the ends of the strap members 15.

Figure 41:
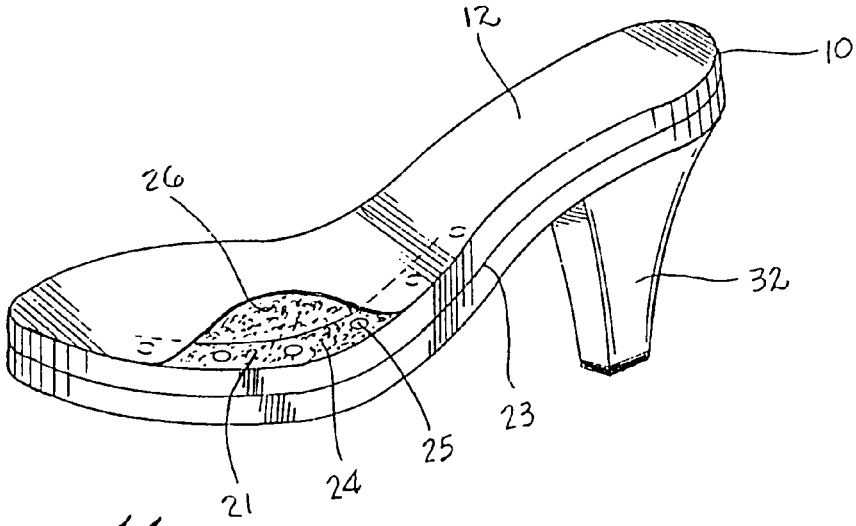
FIG. 41 is a top perspective view of an alternative shoe construction showing a base member, a heel member, and a base member cover, which base member cover has been upturned at a section thereof to expose (1) peripheral apertures extending orthogonal to the plane of the base member, and (2) loop type fastening structure at the top surface periphery of the base member.
Figure 42:
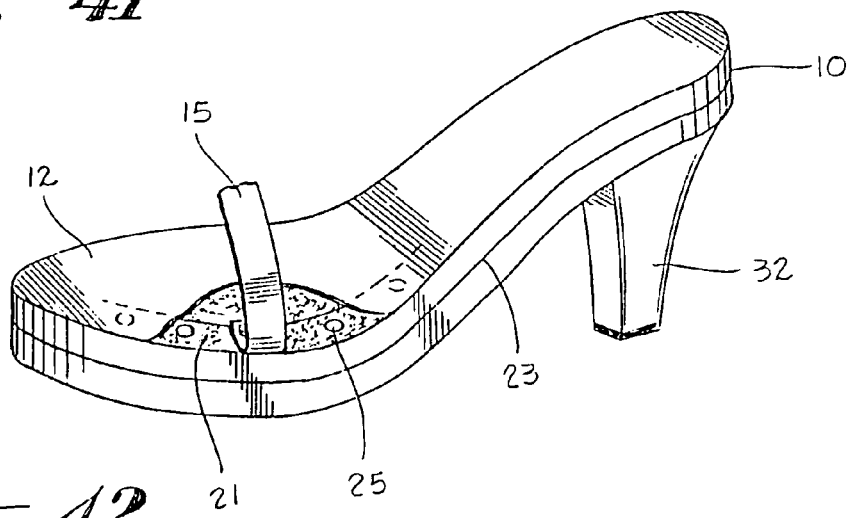
FIG. 42 is a top perspective view of the alternative shoe construction otherwise shown in FIG. 41 showing a fragmentary strap member being attached to the base member via the upturned base member cover and a fastener.

FIG. 41 is a top perspective view of an alternative shoe construction showing a base member 10, a heel member 32, and a top-type base member cover strip 12. The base member cover strip 12 has been upturned at a section thereof to expose (1) peripheral fastener-receiving apertures 25 extending orthogonal to the plane of the base member 10, and (2) loop type fastening structure 24 at the top surface periphery of the base member 10. FIG. 42 is a top perspective view of the alternative shoe construction otherwise shown in FIG. 41 showing a fragmentary strap member 15 being attached to the base member 10 via the upturned base member cover strip 12 and a threaded fastener 20. It is contemplated that the fastener-receiving apertures should be approximately ½ inch apart around the perimeter of the base member 10.

Figure 43:
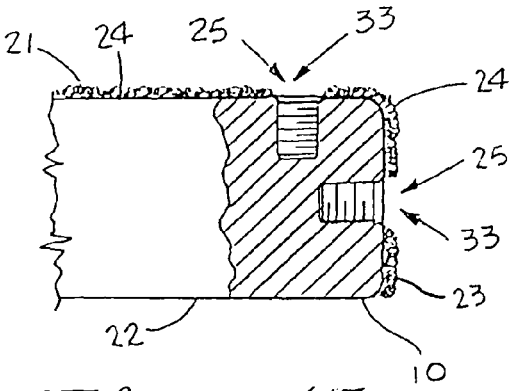
FIG. 43 is an enlarged, fragmentary side view of a side section of the base member with certain parts sectioned away to show threaded, female, fastener-receiving structure.

FIG. 43 is an enlarged, fragmentary side view of a side section of the base member with certain parts sectioned away to show threaded, female, fastener-receiving structure.

Figure 44:
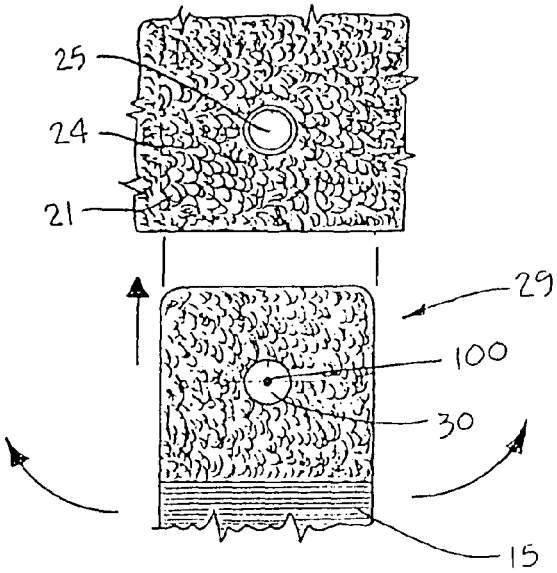
FIG. 44 is (1) a top plan view of an enlarged, fragmentary side section of the base member showing a fastener-receiving aperture surrounded by loop type fastening structure and (2) a top plan view of an enlarged, fragmentary component end section of a strap member showing an end aperture surrounded by loop type fastening structure, the end aperture being aligned with the fastener-receiving aperture.

FIG. 44 is (1) a top plan view of an enlarged, fragmentary side section of the base member showing a fastener-receiving aperture surrounded by loop type fastening structure and (2) a top plan view of an enlarged, fragmentary component end section of a strap member showing an end aperture surrounded by loop type fastening structure, the end aperture being aligned with the fastener-receiving aperture. Notably, the component end 29 of the strap member 15 in this figure has been depicted as rotatable about axis 100 extending through the end aperture 30.

Figure 45:
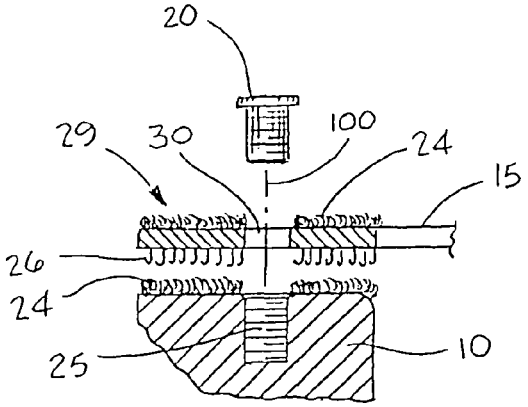
FIG. 45 is an enlarged, fragmentary side sectional view of a side section of the base member, a component end of a strap member, and a fastener in exploded relation to one another, and showing a fastener-receiving aperture of the base member axially aligned with an end aperture of the component end and the fastener.
Figure 46:
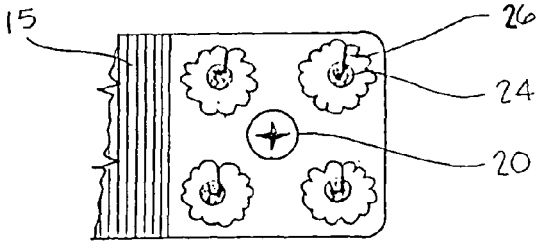
FIG. 46 is a top plan diagrammatic type depiction of a component end of a strap member fastened to a base member via (1) a fastener and (2) hook and loop fastening structure with parts of the component end broken away to show underlying structure, namely loop type fastening structure of the base member attached to hook type fastening structure of the strap member.

FIG. 45 is an enlarged, fragmentary side sectional view of a side section of the base member, a component end of a strap member, and a fastener in exploded relation to one another, and showing a fastener-receiving aperture of the base member axially aligned with an end aperture of the component end and the fastener. FIG. 46 is a top plan diagrammatic type depiction of a component end of a strap member fastened to a base member via (1) a fastener and (2) hook and loop fastening structure with parts of the component end broken away to show underlying structure, namely loop type fastening structure of the base member attached to hook type fastening structure of the strap member.

It may be understood from a comparative inspection of FIGS. 44-47 that after the fastener 20 functions to fasten the component end 29 to the underlying base member 10, that together the fastener 20 and hook and loop fastening structures 26 and 24 prevent the component end 29 from rotating about axis 100 or from becoming otherwise displaced relative to the base member 10 via the robust fastened engagement at the strap-to-base junction site.

The primary purpose of the fastener-receiving apertures 25 is to receive fasteners 20. The apertures and fasteners may be preferably threaded and thus be formed as screw type apertures and fasteners. The screws or fasteners 20 are separate and apart from any other structure and insertable through eyelets or end apertures 30 formed in the strap ends and thereby attachable to the base member 10 via the apertures 25. It is contemplated that concealed fasteners may be constructed with a flat head so that they lie flush to the surface. Visible fasteners, however, may be flat headed or otherwise so as to embellish the shoe construction.

Conceivably, the fastener heads could be formed in a plurality of shapes and colors as generally depicted at fasteners 41, which depicts a flower-shaped fastener head. A separate tool could be provided with the shoe construction so as to enable the insertion and removal of the fasteners with variously shaped heads. Notably, the costs for manufacturing and practicing the shoe construction may be minimized since the same hardware (i.e. fasteners 20) is reusable and may be applied to any shoe construction according to the present invention.

While the above description contains much specificity, this specificity should not be construed as limitations on the scope of the invention, but rather as an exemplification of the invention. For example, as is described hereinabove, it is contemplated that the present invention essentially discloses a shoe construction for enabling a user to selectively attach shoe components. The shoe construction may essentially comprise a base member, a cover construction, at least one top-attachable component, and at least two fasteners.

The base member may essentially comprise a top surface, a bottom surface, a peripheral surface, a first fastening structure, and a series of fastener-receiving apertures. The top and bottom surfaces are preferably being substantially parallel to one another although an arch may be included so as to enhance comfort. The peripheral surface preferably extends substantially orthogonally intermediate the top and bottom surfaces, and the first fastening structure (as may be defined by either hook or loop type fastening structure) surrounds the fastener-receiving apertures.

The cover construction (as earlier specified) may essentially comprise a second fastening structure definable, for example, by loop or hook type fastening structure, but which second fastening structure is matable with the first fastening structure in any event. The top attachable (e.g. a strap member) component may essentially at least two component ends, but depending on its geometry may comprise more than two ends or attachment points as may be required given the application. Each of the component ends may essentially comprise an end aperture and a third fastening structure, as may be defined by the combination of hook and loop type fastening structure situated on each side of the two-sided component end to mate with the cover construction and base member.

The fasteners may thus fasten the component ends to the base member via the end apertures and fastener-receiving apertures. The cover construction may well function to selectively and removably cover (1) the first fastening structure, (2) the component ends, and (3) the fasteners. The first, second, and third fastening structures may well function to prevent rotation and/or displacement of the component ends relative to the base member.

The fastener-receiving apertures may be spaced peripherally around or adjacent the top surface such that the axes of the fastener-receiving apertures extend orthogonally and/or parallel relative to the top surface. The shoe construction may further comprise a bottom attachable component such as a heel construction. The bottom attachable component may comprise an upper component end, which end comprises certain means for fastening said end to the bottom surface of the base member (such as male or female structure engageable or matable with opposing female or male structure).

Accordingly, although the invention has been described by reference to several embodiments, it is not intended that the shoe construction heretofore described be limited thereby, but that modifications thereof are intended to be included as falling within the broad scope and spirit of the foregoing disclosure and the appended drawings.

I claim:

1. A shoe construction, the shoe construction for ambling a user to selectively attach shoe components, the shoe construction comprising:

a base member, the base member comprising a top surface, a bottom surface, a peripheral surface, an apertured, first fastening structure, and a aeries of peripherally-spaced, threaded, fastener-receiving apertures, the top and bottom surfaces being substantially parallel to one another, the peripheral surface extending orthogonally intermediate the top and bottom surfaces, the threaded, fastener-receiving apertures extending both (1) orthogonally into the to surface adjacent the peripheral surface and (2) parallel to the top surface into the peripheral surface, the apertured, first fastening structure comprising apertures coaxial with the threaded, fastener-receiving apertures and thus the apertured, first fastener structure surrounding the fastener-receiving apertures at the top surface;

a cover construction, the cover construction comprising a second fastening structure, the second fastening structure being matable with the first fastening structure;

at least one top attachable component, the top attachable component comprising dual-surface, first and second component ends, the first and second component ends each comprising an end aperture and a third fastening structure, the third fastening structure being cooperably associated with both (1) a first surface and (2) an opposed second surface of the dual-surfaced first and second component ends; and at least two threaded fasteners, the threaded fasteners for fastening the first and second component ends to the base member via the end apertures and threaded, fastener-receiving apertures, the cover construction for selectively and removably covering (a) the apertured, first fastening structure, (b) the first and second component ends, and (c) the threaded fasteners, the third fastening structure, being (i) cooperably lied to the opposed first and second surfaces of the first and second component ends, and (ii) cooperably and respectively matable with the first and second fastening structures of the base member and cover construction, for preventing rotation of the first and second component ends about axes extending through and coaxial with the threaded fasteners, the third fastening structure thus for enhancing the threadably fastened securement of the threaded fasteners.

2. The shoe construction of claim 1 wherein the bottom surface comprises threaded bottom surface structure, and the shoe construction comprises at least one bottom attachable component, the bottom attachable component comprising an upper component end, the upper component end comprising threaded bottom attachable component structure, the threaded bottom surface structure and the threaded bottom attachable component structure being threadably matable for fastening said upper component end to the bottom surface.

3. A shoe construction, the shoe construction for enabling a user to selectively attach shoe components, the shoe construction comprising:

a base member, the base member comprising a top surface, a bottom surface, a peripheral surface, an apertured first fastening structure, and a series of threaded, fastener-receiving apertures, the top and bottom surfaces being substantially parallel to one another, the peripheral surface extending intermediate the top and bottom surfaces, the apertured, first fastening structure comprising apertures coaxial with the threaded, fastener-receiving apertures and thus the apertured, first fastener structure surrounding the threaded, fastener-receiving apertures at the top surface;

a cover construction, the cover construction comprising a second fastening structure, the second fastening structure being matable with the first fastening structure;

at least one top attachable component, the top attachable component comprising dual-surface, first and second component ends, the first and second component ends each comprising an end aperture and a third fastening structure, the third fastening structure being cooperably associated with both (1) a first surface and (2) a second surface of the dual-surfaced, first and second component ends; and at least two threaded fasteners, the threaded fasteners for fastening the first and second component ends to the base member via the end apertures and threaded, fastener-receiving apertures, the cover construction for selectively and removably covering (a) the apertured, first fastening structure, (b) the first and second component ends, and (c) the threaded fasteners, the first, second, and third fastening structures being cooperable for preventing rotation of the first and second component ends about axes extending through and coaxial with the threaded fasteners, and thus for enhancing the threadably fastened securement of the threaded fasteners.

4. The shoe construction of claim 3 wherein the series of threaded, fastener-receiving apertures are spaced peripherally around the base member.

5. The shoe construction of claim 4 wherein the series of threaded, fastener-receiving apertures extend orthogonally relative to the top surface.

6. The shoe construction of claim 3 wherein the bottom surface comprises threaded bottom surface structure, and the shoe construction comprises at least one bottom attachable component, the bottom attachable component comprising an upper component end, the upper component end comprising threaded bottom attachable component structure, the threaded bottom surface structure and the threaded bottom attachable component structure being threadably matable for fastening said upper component end to the bottom surface.

7. A shoe construction, the shoe construction for enabling a user to selectively attach shoe components, the shoe construction comprising:

a base member, the base member comprising a top surface, a bottom surface, a peripheral surface, and a first fastening structure, the top and bottom surfaces being substantially parallel to one another, the peripheral surface extending intermediate the top and bottom surfaces;

a cover construction, the cover construction comprising a second fastening structure, the second fastening structure being matable with the first fastening structure; and at least one top attachable component, the top attachable component comprising dual-surfaced, first and second component ends, the first and second component ends each comprising third fastening structure, the third fastening structure being cooperably associated with both (1) a first surface and (2) an opposed second surface of the dual-surfaced, first and second component ends, the third fastening structure for fastening the first and second component ends to the base member intermediate the first and second fastening structure, the cover construction for selectively and removably covering (a) the first fastening structure, and (b) the first and second component ends, the third fastening structure, being (i) cooperably applied to the opposed first and second surfaces of the first and second component ends, and (ii) cooperably and respectively matable with the first and second fastening structures of the base member and corer construction, for preventing rotation of the first and second component ends about axes extending orthogonally therethrough.

8. The shoe construction of claim 7 wherein the base member comprises a series of threaded, fastener-receiving apertures and a select dual, surfaced component end comprises an end aperture, the select component end being selected from the group consisting of the first and second component ends, at least one threaded fastener being receivable by the select component end and a select threaded, fastener-receiving aperture for attaching the top attachable component to the base member, the third fastening structure, being (i) cooperably applied to opposed first and second surfaces of the select component end, and (ii) cooperably and respectively matable with the first and second fastening structures of the base member and cover construction, for preventing rotation of the select component end about an axis extending through and coaxial with the threaded fastener, the third fastening structure thus for enhances the threadably fastened securement of the threaded fastener.

9. The shoe construction of claim 8 wherein the series of threaded, fastener-receiving apertures extend orthogonally relative to the top surface.

10. The shoe construction of claim 8 wherein the first fastening structure is apertured, the apertured, first fastening structure comprising apertures coaxial with the threaded, fastener-receiving apertures and thus the apertured, first fastener structure surrounding the apertured, fastener-receiving apertures, the first, second, and third fastening structures for cooperably preventing rotation of the select component end about an axis extending through and coaxial with the threaded, fastener-receiving aperture.

11. The shoe construction of claim 7 wherein the bottom surface comprises threaded bottom surface structure, and the shoe construction comprises at least one bottom attachable component, the bottom attachable component comprising an upper component end, the upper component end comprising threaded bottom attachable component structure, the threaded bottom surface structure and the threaded bottom attachable component structure being thread ably matable for fastening said upper component end to the bottom surface.

12. A shoe construction, the shoe construction for enabling a user to selectively attach shoe components, the shoe construction comprising:

a base member, a cover construction, at least one top attachable component, and threaded fasteners, the base member comprising a top surface, a bottom surface, a peripheral surface, and a series of threaded, fastener-receiving apertures, the top and bottom surfaces being substantially parallel to one another, the peripheral surface extending intermediate the top and bottom surfaces, the top attachable component comprising dual-surfaced, component ends, the dual-surfaced, component ends each comprising an end aperture, the threaded fasteners for threadably fastening the dual-surfaced, component ends to the base member via the end apertures and threaded fastener-receiving apertures, the cover construction for selectively and removably covering the top and peripheral surfaces and the component ends.

13. The shoe construction of claim 12 wherein the threaded, fastener-receiving apertures extend orthogonally relative to the top surface.

14. The shoe construction of claim 12 wherein the cover construction selectively and removably covers the threaded fasteners.

15. The shoe construction of claim 12 wherein the bottom surface comprises threaded bottom surface structure, and the shoe construction comprises at least one bottom attachable component, the bottom attachable component comprising an upper component end, the upper component end comprising threaded bottom attachable component structure, the threaded bottom surface structure and the threaded bottom attachable component structure being threadably matable for fastening said upper component end to the bottom surface.

16. The shoe construction of claim 12 wherein the base member comprises apertured, first fastening structure, the cover construction comprises second fastening structure, and the dual-surfaced, component ends comprise third fastening structure, the third fastening structure being cooperably associated with both (1) a first surface and (2) an opposed second surface of the dual-surfaced, component ends, the apertured, first fastening structure comprising apertures coaxial with the threaded, fastener-receiving apertures and thus the apertured, first fastener structure surrounding the threaded, fastener-receiving apertures at the top surface, the first, second, and third fastening structures being cooperably matable for preventing rotation of the component ends about axes extending through and coaxial with the threaded, fastener-receiving apertures and threaded fasteners thereby enhancing the threadably fastened securement of the threaded fasteners.

* * * * *